US010663203B2

(12) United States Patent
Miyakoshi et al.

(10) Patent No.: US 10,663,203 B2
(45) Date of Patent: May 26, 2020

(54) ICE MAKING DEVICE

(71) Applicant: FUJI ELECTRIC CO., LTD., Kawasaki-shi, Kanagawa (JP)

(72) Inventors: Tomoya Miyakoshi, Mie (JP); Nobutoshi Migishima, Fukuya (JP); Hajime Erikawa, Kumagaya (JP)

(73) Assignee: FUJI ELECTRIC CO., LTD., Kawasaki-shi, Kanagawa (JP)

( * ) Notice: Subject to any disclaimer, the term of this patent is extended or adjusted under 35 U.S.C. 154(b) by 137 days.

(21) Appl. No.: 15/905,236

(22) Filed: Feb. 26, 2018

(65) Prior Publication Data

US 2018/0252456 A1 Sep. 6, 2018

(30) Foreign Application Priority Data

Mar. 1, 2017 (JP) ..... 2017-038181
May 17, 2017 (JP) ..... 2017-098077
Dec. 21, 2017 (JP) ..... 2017-245113

(51) Int. Cl.
*F25C 1/246* (2018.01)
*F25C 1/04* (2018.01)
(Continued)

(52) U.S. Cl.
CPC ..... *F25C 1/246* (2013.01); *F25B 5/00* (2013.01); *F25B 49/02* (2013.01); *F25C 1/04* (2013.01);
(Continued)

(58) Field of Classification Search
CPC F25B 41/062; F25B 49/02; F25B 2600/2513; F25B 2600/21; F25C 1/00; F25C 1/246; F25C 1/04; F25C 2600/04
See application file for complete search history.

(56) References Cited

U.S. PATENT DOCUMENTS 4,217,762 A 8/1980 Sakamoto et al.
7,318,323 B2 1/2008 Tatsui et al.
(Continued)

FOREIGN PATENT DOCUMENTS

CN 1849489 A 10/2006
CN 101336357 A 12/2008
(Continued)

OTHER PUBLICATIONS

China Patent Office, "Office Action for Chinese Patent Application No. 201810171095.1," dated Jan. 16, 2020.

*Primary Examiner* — Ana M Vazquez
(74) *Attorney, Agent, or Firm* — Manabu Kanesaka

(57) ABSTRACT

An ice making device includes: an ice making part in which an evaporator is incorporated; a refrigerating circuit for ice making including a compressor, a condenser, an electronic expansion valve, and the evaporator, the refrigerating circuit being configured to circulate a refrigerant through the compressor, the condenser, the electronic expansion valve, and the evaporator in this order to produce ice in the ice making part; and a controller configured to increase a circulation amount of the refrigerant in the refrigerating circuit and then reduce the circulation amount in accordance with reduction in a cooling load in the ice making part when receiving an ice making command, and adjust the circulation amount such that a degree of superheat is equal to or lower than 2° C.

4 Claims, 22 Drawing Sheets

(51) Int. Cl.

| | |
|---|---|
| ***F25B 5/00*** | (2006.01) |
| ***F28F 1/02*** | (2006.01) |
| ***F25B 49/02*** | (2006.01) |
| ***F25C 5/10*** | (2006.01) |

(52) U.S. Cl.

CPC ..... *F25C 5/10* (2013.01); *F28F 1/022* (2013.01); *F25B 2600/21* (2013.01); *F25B 2600/2513* (2013.01); *F25C 2300/00* (2013.01); *F25C 2600/02* (2013.01); *F25C 2600/04* (2013.01); *F25C 2700/14* (2013.01)

(56) References Cited

U.S. PATENT DOCUMENTS

| | | | |
|---|---|---|---|
| 7,536,867 | B2 | 5/2009 | Kaga et al. |
| 7,743,618 | B2 | 6/2010 | Kaga et al. |
| 8,069,683 | B2 | 12/2011 | Lifson |

FOREIGN PATENT DOCUMENTS

| | | | | |
|---|---|---|---|---|
| CN | 106247718 | A | | 12/2016 |
| JP | 2010-169304 | A | | 8/2010 |
| JP | 2010169304 | A | * | 8/2010 |
| JP | 2016-217549 | A | | 12/2016 |

* cited by examiner

FIG.6
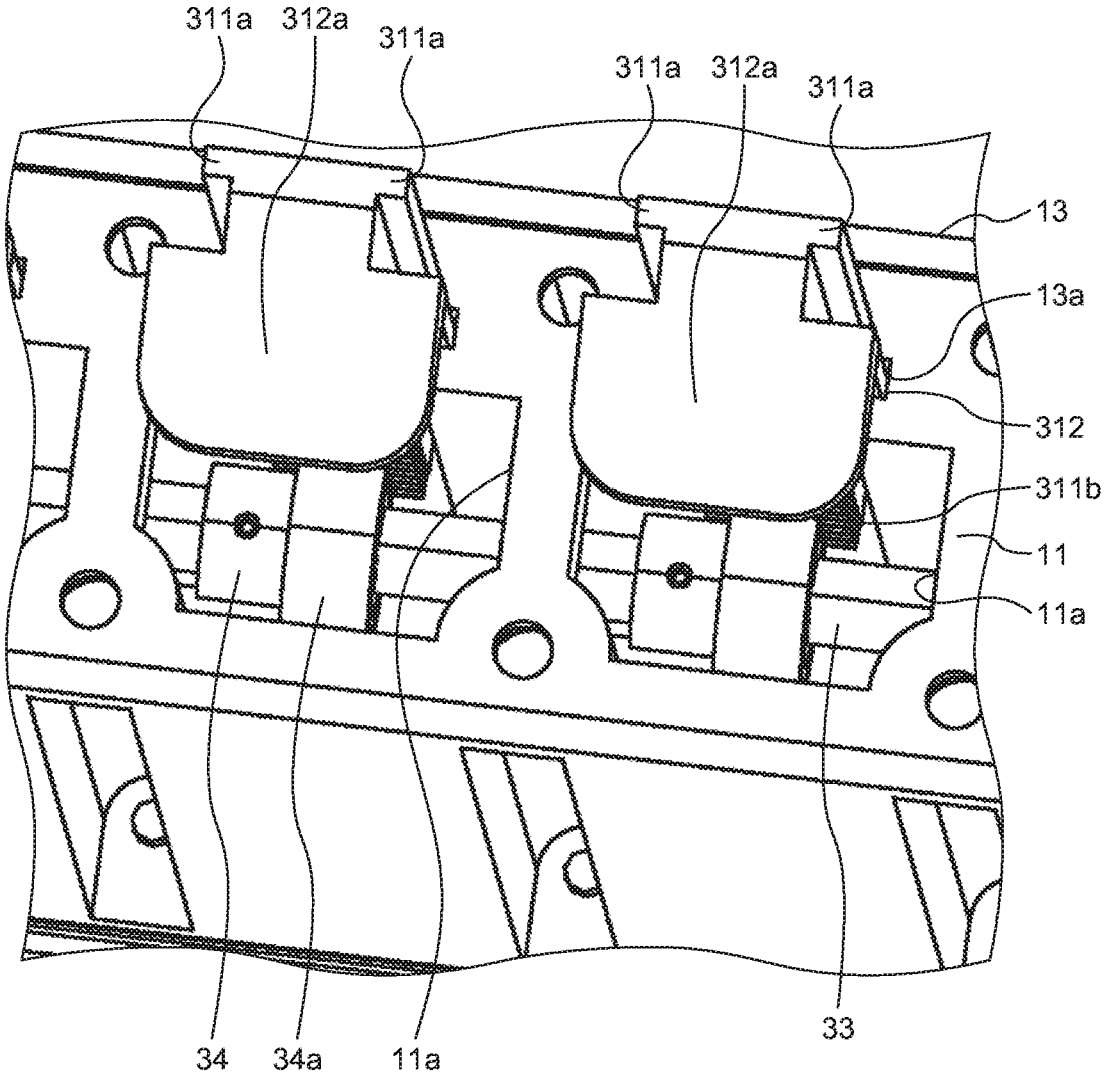
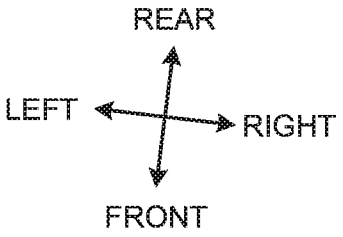

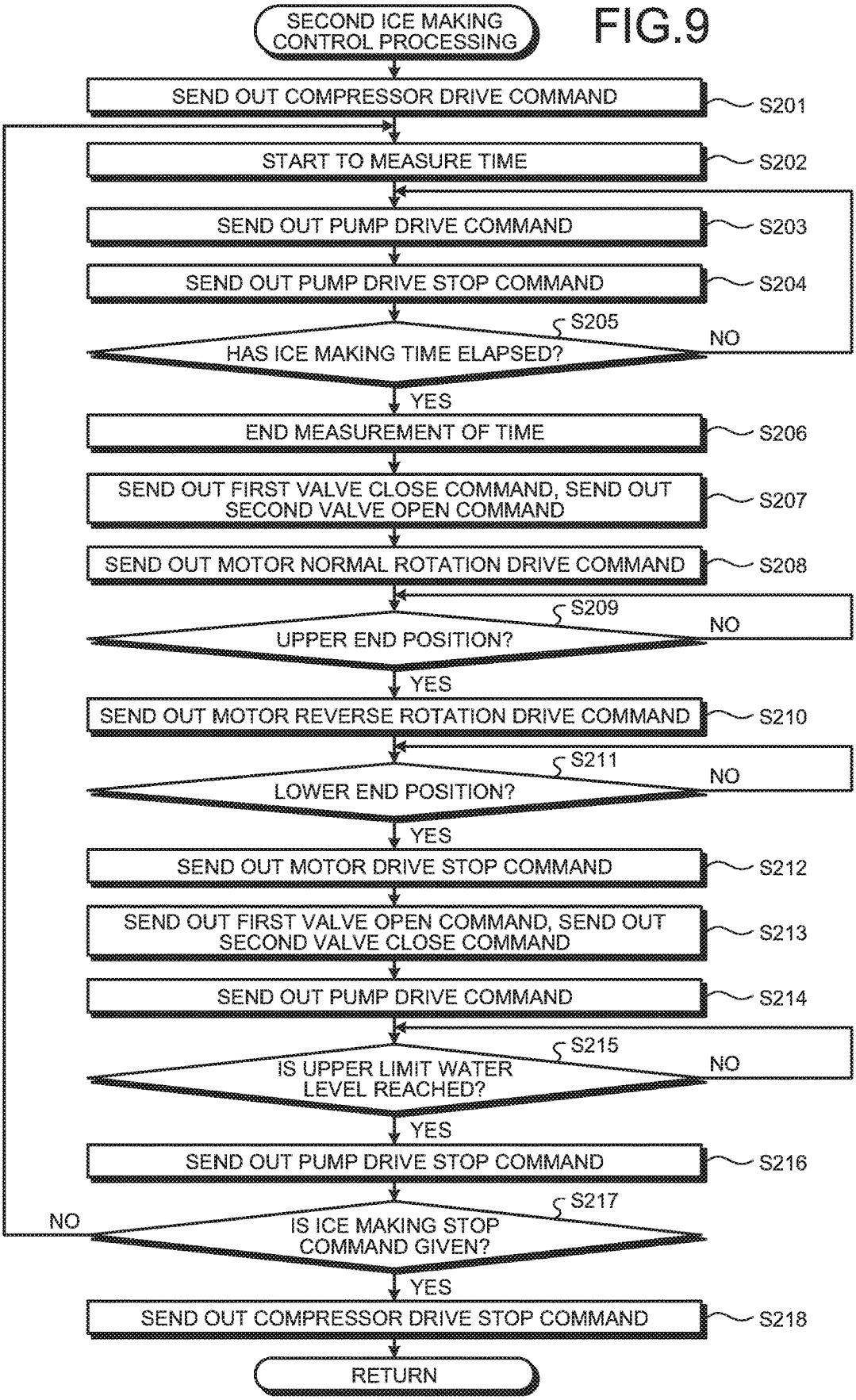
SECOND ICE MAKING CONTROL PROCESSING
FIG.9
SEND OUT COMPRESSOR DRIVE COMMAND
S201
START TO MEASURE TIME
S202
SEND OUT PUMP DRIVE COMMAND
S203
SEND OUT PUMP DRIVE STOP COMMAND
S204
S205
HAS ICE MAKING TIME ELAPSED?
NO
YES
END MEASUREMENT OF TIME
S206
SEND OUT FIRST VALVE CLOSE COMMAND, SEND OUT SECOND VALVE OPEN COMMAND
S207
SEND OUT MOTOR NORMAL ROTATION DRIVE COMMAND
S208
S209
UPPER END POSITION?
NO
YES
SEND OUT MOTOR REVERSE ROTATION DRIVE COMMAND
S210
S211
LOWER END POSITION?
NO
YES
SEND OUT MOTOR DRIVE STOP COMMAND
S212
SEND OUT FIRST VALVE OPEN COMMAND, SEND OUT SECOND VALVE CLOSE COMMAND
S213
SEND OUT PUMP DRIVE COMMAND
S214
S215
IS UPPER LIMIT WATER LEVEL REACHED?
NO
YES
SEND OUT PUMP DRIVE STOP COMMAND
S216
S217
NO
IS ICE MAKING STOP COMMAND GIVEN?
YES
SEND OUT COMPRESSOR DRIVE STOP COMMAND
S218
RETURN

ICE MAKING DEVICE

CROSS-REFERENCE TO RELATED APPLICATION(S)

The present application claims priority to and incorporates by reference the entire contents of Japanese Patent Application No. 2017-038181 filed in Japan on Mar. 1, 2017, Japanese Patent Application No. 2017-098077 filed in Japan on May 17, 2017, and Japanese Patent Application No. 2017-245113 filed in Japan on Dec. 21, 2017.

BACKGROUND

1. Technical Field

The present disclosure relates to an ice making device.

2. Related Art

In the related art, such a type of ice making device includes a refrigerating circuit for ice making including a compressor, a condenser, an expansion mechanism, and an evaporator. The compressor suctions and compresses a refrigerant. The condenser causes the refrigerant compressed by the compressor to radiate heat and be condensed. The expansion mechanism decompresses the refrigerant condensed by the condenser to be adiabatically expanded. The evaporator evaporates the refrigerant adiabatically expanded by the expansion mechanism, and is incorporated in an ice making part.

In such an ice making device, the compressor works and the refrigerant compressed by the compressor circulates in the refrigerating circuit while passing through the condenser, the expansion mechanism, and the evaporator in this order. Accordingly, ice is produced by the ice making part (for example, refer to Japanese Laid-open Patent Publication No. 2010-169304).

SUMMARY

However, in the ice making device described above, the refrigerant supplied to the evaporator is evaporated while passing through the evaporator, ice is hardly produced in the vicinity of a refrigerant outlet of the evaporator, and time for producing ice fluctuates in the ice making part. Thus, to produce a certain amount of ice by the ice making part, driving time of the compressor is required more than necessary.

It is an object of the disclosure to at least partially solve the problems in the conventional technology.

In some embodiments, an ice making device includes: an ice making part in which an evaporator is incorporated; a refrigerating circuit for ice making including a compressor, a condenser, an electronic expansion valve, and the evaporator, the refrigerating circuit being configured to circulate a refrigerant through the compressor, the condenser, the electronic expansion valve, and the evaporator in this order to produce ice in the ice making part; and a controller configured to increase a circulation amount of the refrigerant in the refrigerating circuit and then reduce the circulation amount in accordance with reduction in a cooling load in the ice making part when receiving an ice making command, and adjust the circulation amount such that a degree of superheat is equal to or lower than 2° C., the degree of superheat being a difference between a refrigerant temperature at an inlet of the evaporator and a refrigerant temperature at an outlet of the evaporator.

In some embodiments, an ice making device includes: an ice making part in which an evaporator is incorporated; a refrigerating circuit for ice making including a compressor, a condenser, an electronic expansion valve, and the evaporator, the refrigerating circuit being configured to circulate a refrigerant through the compressor, the condenser, the electronic expansion valve, and the evaporator in this order to produce ice in the ice making part. The ice making part includes an ice making main body in which a plurality of tubular bodies are continuously arranged in parallel. The evaporator includes a refrigerant pipe part having a flat shape in which a plurality of refrigerant passages are arranged in parallel. The refrigerant pipe part is arranged being curved around the ice making main body to be incorporated in the ice making part such that an inner face of the refrigerant pipe part is thermally connected to a front face and a rear face of the ice making main body. The refrigerating circuit for ice making includes a switch configured to be switched for each predetermined time between a first sending-out state in which the refrigerant decompressed by the electronic expansion valve is sent out to one end part of the refrigerant pipe part and a second sending-out state in which the refrigerant decompressed by the electronic expansion valve is sent out to another end part of the refrigerant pipe part.

In some embodiments, an ice making device includes: an ice making part in which an evaporator is incorporated; a refrigerating circuit for ice making including a compressor, a condenser, an electronic expansion valve, and the evaporator, the refrigerating circuit being configured to circulate a refrigerant through the compressor, the condenser, the electronic expansion valve, and the evaporator in this order to produce ice in the ice making part. The ice making part includes an ice making main body in which a plurality of tubular bodies are continuously arranged in parallel. The evaporator includes: a first refrigerant pipe part having a flat shape in which a plurality of refrigerant passages are arranged in parallel; and a second refrigerant pipe part having a flat shape in which a plurality of refrigerant passages are arranged in parallel. The first refrigerant pipe part is arranged being curved around the ice making main body such that an inner face of the first refrigerant pipe part is thermally connected to a front face and a rear face of the ice making main body, and the second refrigerant pipe part is arranged being thermally connected to the first refrigerant pipe part and incorporated in the ice making part such that the refrigerant passing through the refrigerant passages of the second refrigerant pipe part is opposed to the refrigerant passing through the refrigerant passages of the first refrigerant pipe part.

The above and other objects, features, advantages and technical and industrial significance of this disclosure will be better understood by reading the following detailed description of presently preferred embodiments of the disclosure, when considered in connection with the accompanying drawings.

BRIEF DESCRIPTION OF THE DRAWINGS

FIG. 6 is a perspective view illustrating an enlarged upper wall part of an ice storage part illustrated in FIGS. 1 and 3;

FIG. 9 is a flowchart illustrating processing content of second ice making control processing performed by the controller illustrated in FIG. 2;

DETAILED DESCRIPTION

The following describes preferred embodiments of an ice making device according to the disclosure in detail with reference to the attached drawings.

First Embodiment

Figure 1:
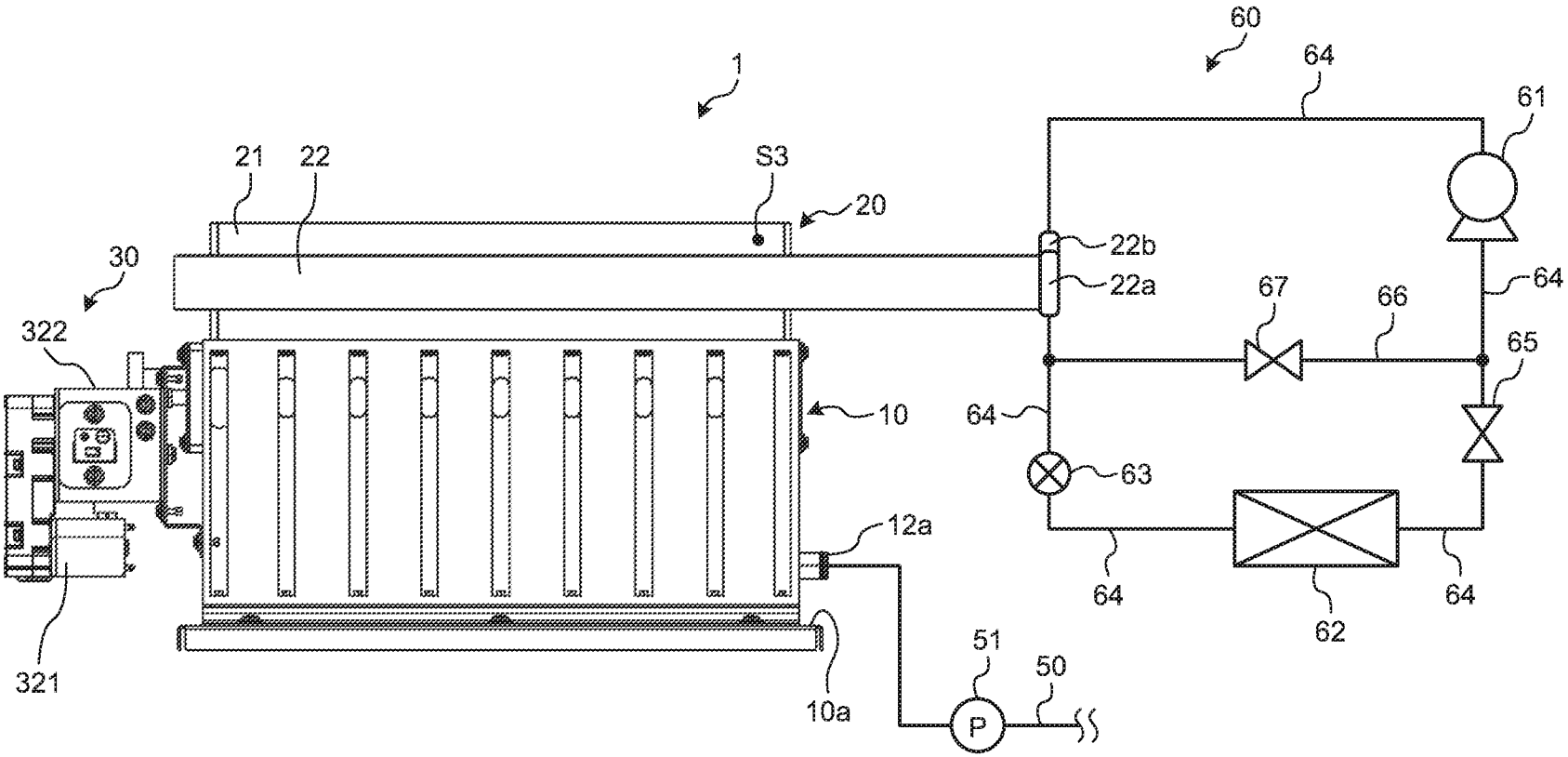
FIG. 1 is a schematic diagram schematically illustrating an ice making device according to a first embodiment of the disclosure.
Figure 2:
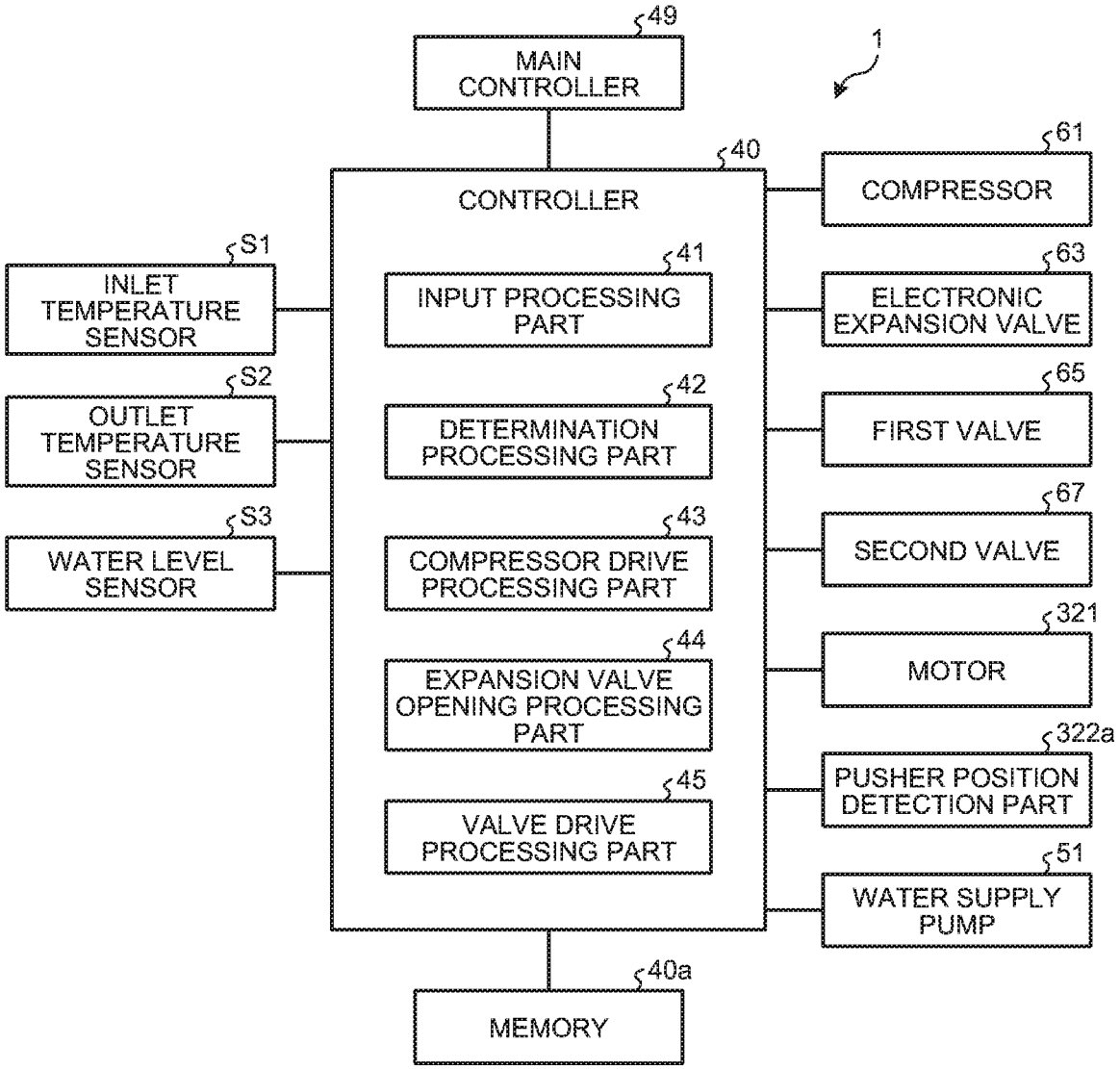
FIG. 2 is a block diagram schematically illustrating a characteristic control system of the ice making device according to the first embodiment of the disclosure.

FIG. 1 is a schematic diagram schematically illustrating an ice making device according to a first embodiment of the disclosure, and FIG. 2 is a block diagram schematically illustrating a characteristic control system of the ice making device according to the first embodiment of the disclosure. An ice making device 1 exemplified herein includes a water storage part 10, an ice making part 20, an ice carrying-out module 30, an inlet temperature sensor S1, an outlet temperature sensor S2, and a controller 40.

Figure 3:
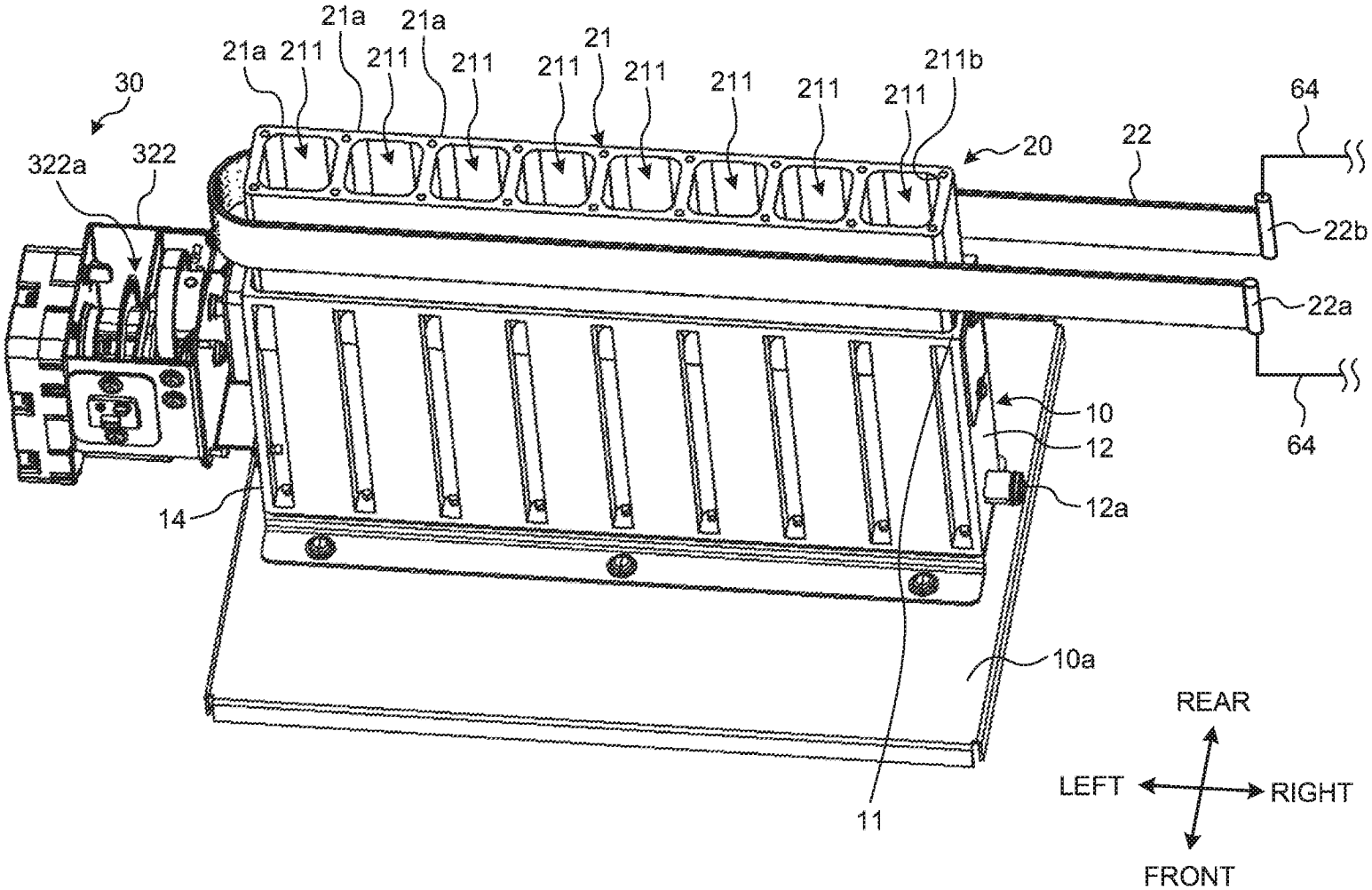
FIG. 3 is a perspective view illustrating an enlarged principal part of the ice making device illustrated in FIG. 1.

As illustrated in FIG. 3, the water storage part 10 is placed on a base 10*a*, and has a rectangular parallelepiped shape in which a plurality of (eight) upper wall openings 11*a* (refer to FIG. 6) are arranged side by side on an upper wall part 11. An introduction port 12*a* is formed on a right wall part 12 of the water storage part 10, and the water storage part 10 is connected to a water supply line 50 via the introduction port 12*a*.

The water supply line 50 is a path through which water is supplied to the water storage part 10, and a water supply pump 51 is arranged in the middle of the water supply line 50. Receiving a command from the controller 40, the water supply pump 51 works and constitutes a water supply module for supplying water to the water storage part 10 via the water supply line 50 when working. A cooling module (not illustrated) for cooling water to be stored is arranged in the water storage part 10, and the water to be stored is cooled to about 4° C. by the cooling module, for example.

The ice making part 20 includes an ice making main body 21 and a refrigerant pipe part 22. The ice making main body 21 is made of aluminum. The ice making main body 21 is configured such that a plurality of (eight) tubular bodies 21*a* each having a hollow part 211 extending in a vertical direction are continuously arranged side by side. The ice making main body 21 is placed on the upper wall part 11 such that a lower surface opening 211*a* (refer to FIG. 4) of each hollow part 211 communicates with a corresponding upper wall opening 11*a*. Herein, a front and rear width and a left and right width of the hollow part 211 is substantially equivalent to the front and rear width and the left and right width of the upper wall opening 11*a*.

A water level sensor S3 is arranged in the ice making part 20. The water level sensor S3 detects whether a water level of water that has entered the hollow part 211 reaches an upper limit. The water level sensor S3 sends out, as a signal, the fact that the upper limit water level is reached to the controller 40 when the water level reaches the upper limit.

Figure 4:
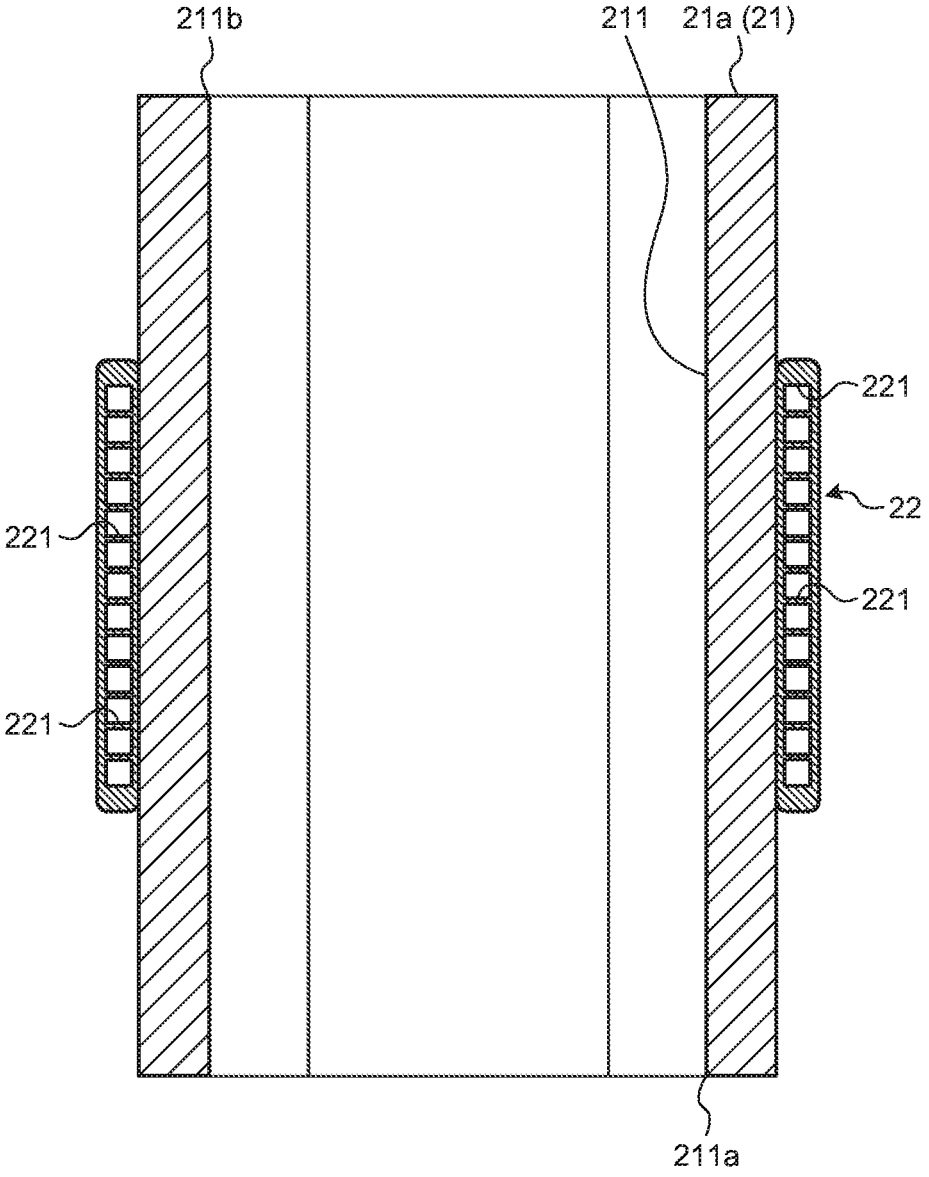
FIG. 4 is a vertical cross-sectional view of the ice making part illustrated in FIGS. 1 and 3.

The refrigerant pipe part 22 is made of aluminum similarly to the ice making main body 21. As illustrated in FIG. 4, the refrigerant pipe part 22 is a perforated tube having a flat shape in which a plurality of refrigerant passages 221 are arranged in parallel. The refrigerant pipe part 22 is arranged around the ice making main body 21 in a state in which an inner face of the refrigerant pipe part 22 is thermally connected to a front face and a rear face of the ice making main body 21. An inlet header 22*a* is arranged at one end of the refrigerant pipe part 22 to communicate with each refrigerant passage 221, and an outlet header 22*b* is arranged at the other end thereof to communicate with each refrigerant passage 221.

The refrigerant pipe part 22 constitutes, as an evaporator, a refrigerating circuit for ice making 60 together with a compressor 61, a condenser 62, and an electronic expansion valve 63. The refrigerating circuit for ice making 60 is configured by sequentially connecting the compressor 61, the condenser 62, the electronic expansion valve 63, and the refrigerant pipe part (evaporator) 22 via a refrigerant pipeline 64, and encloses the refrigerant therein.

The compressor 61 includes a suction part connected to the outlet header 22*b* via the refrigerant pipeline 64, and works when receiving a drive command from the controller 40. When working, the compressor 61 suctions and compresses the refrigerant from the refrigerant pipe part 22 and discharges the compressed refrigerant through a discharging part.

An inlet of the condenser 62 is connected to the discharging part of the compressor 61 via the refrigerant pipeline 64. The condenser 62 exchanges heat of the refrigerant discharged from the compressor 61 with heat of the ambient air, and causes the refrigerant to be condensed. A first valve 65 is arranged in the middle of the refrigerant pipeline 64 connecting the compressor 61 with the condenser 62.

The first valve 65 is a valve body that opens and closes in response to a command given from the controller 40, which allows the refrigerant discharged from the compressor 61 to pass therethrough toward the condenser 62 in an opened state, and regulates passage of the refrigerant discharged from the compressor 61 toward the condenser 62 in a closed state.

An inlet side of the electronic expansion valve 63 is connected to an outlet of the condenser 62 via the refrigerant pipeline 64, and an outlet side thereof is connected to the inlet header 22*a* via the refrigerant pipeline 64. The electronic expansion valve 63 has an opening that is adjusted in accordance with a command given from the controller 40, decompresses the refrigerant condensed by the condenser 62 to be adiabatically expanded, and supplies the refrigerant to the refrigerant pipe part 22.

In the refrigerating circuit for ice making 60, a bypass pipeline 66 is arranged to join the middle of the refrigerant pipeline 64 connecting the electronic expansion valve 63 with the inlet header 22*a*, the bypass pipeline 66 being branched from an upstream side of the first valve 65 in the refrigerant pipeline 64 connecting the compressor 61 with the condenser 62. A second valve 67 is arranged in the middle of the bypass pipeline 66.

The second valve 67 is a valve body that opens and closes in response to a command given from the controller 40, which allows the refrigerant discharged from the compressor 61 to pass through the bypass pipeline 66 toward the inlet header 22*a* in an opened state, and regulates passage of the refrigerant discharged from the compressor 61 through the bypass pipeline 66 in a closed state.

The refrigerant pipe part 22 cools or heats the ice making main body 21 that is thermally connected thereto when the refrigerant that has flowed in through the inlet header 22*a* passes through a refrigerant passage 221. That is, when the refrigerant adiabatically expanded by the electronic expansion valve 63 passes through the refrigerant passage 221, the refrigerant pipe part 22 cools the ice making main body 21 to below the freezing point when the refrigerant is evaporated, but when the refrigerant compressed to be discharged by the compressor 61 flows in through the bypass pipeline 66 and passes through the refrigerant passage 221, the refrigerant pipe part 22 heats the ice making main body 21.

Figure 5:
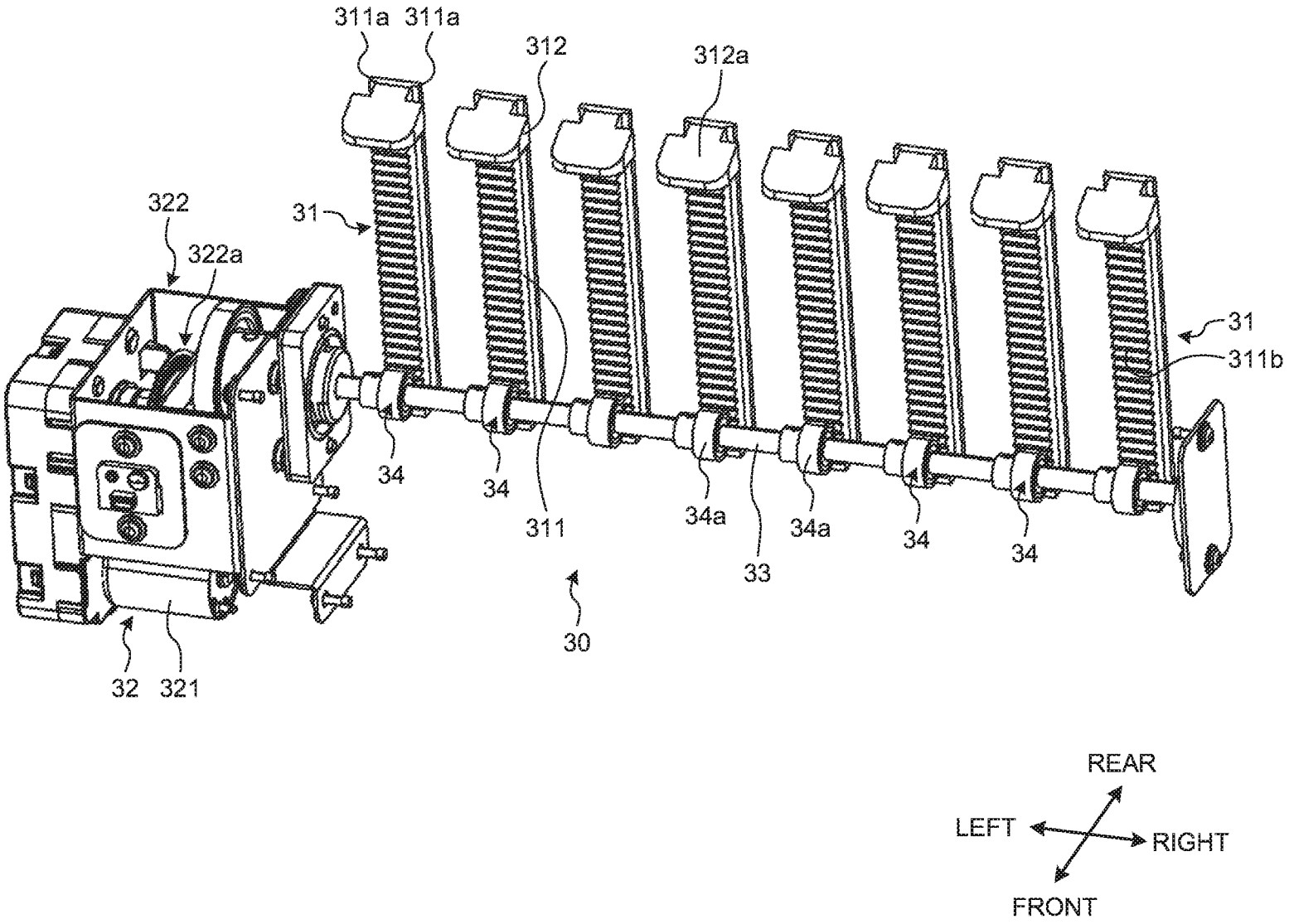
FIG. 5 is a perspective view illustrating an ice carrying-out module illustrated in FIG. 1.

FIG. 5 is a perspective view illustrating the ice carrying-out module 30 illustrated in FIG. 1. As illustrated in FIG. 5, the ice carrying-out module 30 includes a pusher member 31 and a driving part 32.

A plurality of (in the illustrated example, eight) pusher members 31 are arranged, and each of the pusher members 31 is associated with a corresponding one of the tubular bodies 21*a* (hollow parts 211) of the ice making main body 21. Each pusher member 31 is configured by integrally molding a base 311 and an upper end part 312.

The base 311 is a long member the vertical direction of which is a longitudinal direction, and as illustrated in FIG. 6, a projecting piece 311*a* projecting toward the left and the right is arranged at a rear end portion thereof. A base gear unit 311*b* constituted of a plurality of teeth is formed at a front end part of the base 311. The projecting piece 311*a* of the base 311 enters a groove part 13*a* formed to be continuous to the upper wall part 11 in a rear wall part 13 of the water storage part 10. Accordingly, the pusher member 31 is arranged in the water storage part 10 to be movable along the vertical direction.

The upper end part 312 is arranged to continue to an upper end portion of the base 311 and protrude further forward than a front end of the base 311. The front and rear width of the upper end part 312 is slightly smaller than the front and rear width of the upper wall opening 11*a* and the front and rear width of the hollow part 211, and the left and right width of the upper end part 312 is slightly smaller than the left and right width of the upper wall opening 11*a* and the left and right width of the hollow part 211. An upper surface 312*a* of the upper end part 312 gradually inclines downward toward the front.

The driving part 32 includes a motor 321 and a transmission unit 322. The motor 321 is a driving source that works in accordance with a command given from the controller 40. The motor 321 works to normally rotate when a normal rotation drive command is given from the controller 40, and works to reversely rotate when a reverse rotation drive command is given from the controller 40. That is, the motor 321 can rotate normally or reversely.

The transmission unit 322 transmits rotational driving of the motor 321 to a shaft part 33. Herein, the shaft part 33 is arranged to be rotatable about a center axis of itself between the right wall part 12 and a left wall part 14 inside the water storage part 10. A plurality of (eight) transmission parts 34 are attached to the shaft part 33 at intervals of the pusher member 31. The transmission part 34 is a cylindrical member attached to the shaft part 33 so as to project to the outside of the shaft part 33 in a radial direction, and a transmission gear part 34*a* constituted of a plurality of teeth is formed on a peripheral surface of the transmission part 34. Part of the transmission gear part 34*a* is engaged with part of the base gear unit 311*b*.

Figure 7:
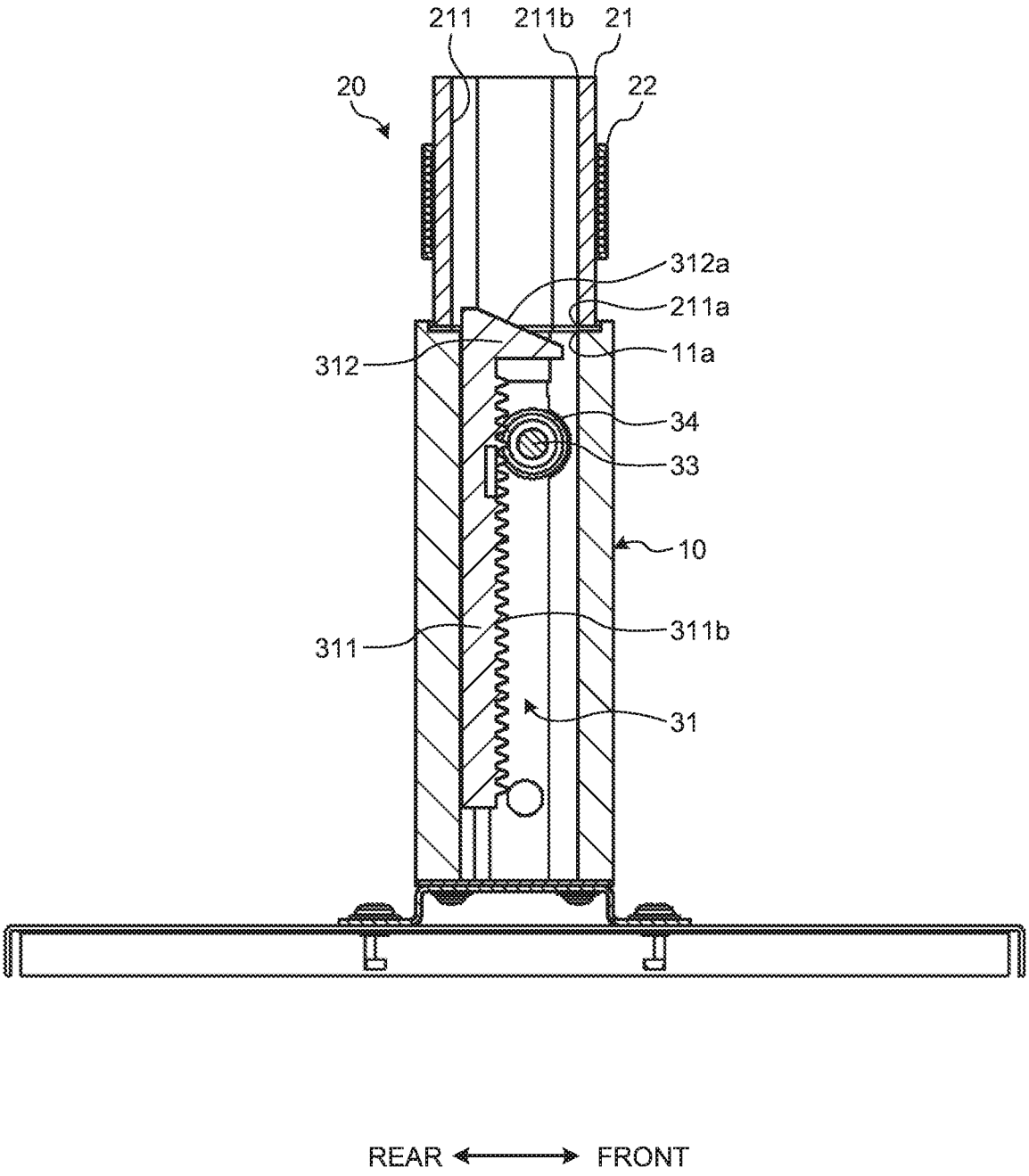
FIG. 7 is a vertical cross-sectional view schematically illustrating a principal part of the ice making device illustrated in FIG. 1.

A pusher position detection part 322*a* is arranged in the transmission unit 322, the pusher position detection part 322*a* detecting the position of the pusher member 31 based on rotational driving force given from the motor 321 to the shaft part 33 like an encoder, for example. When detecting that the pusher member 31 is positioned at a lower end position (first position) as a lower limit, the pusher position detection part 322*a* sends out the fact to the controller 40 as a detection signal. When detecting that the pusher member 31 is positioned at an upper end position (second position) as an upper limit, the pusher position detection part 322*a* sends out the fact to the controller 40 as a detection signal. Accordingly, the pusher member 31 is movable along a vertical direction between the lower end position and the upper end position. When the pusher member 31 is arranged at the lower end position, as illustrated in FIG. 7, an upper end part 312 substantially blocks the lower surface opening 211*a* of the hollow part 211.

The inlet temperature sensor S1 is arranged in the vicinity of the inlet header 22*a* of the refrigerant pipe part 22. The inlet temperature sensor S1 is a detection module that detects a refrigerant temperature at an inlet (hereinafter, also referred to as an inlet temperature) for flowing in the refrigerant pipe part 22, and sends out the inlet temperature as a detection result thereof to the controller 40 as an inlet temperature signal as needed.

The outlet temperature sensor S2 is arranged in the vicinity of the outlet header 22*b* of the refrigerant pipe part 22. The outlet temperature sensor S2 is a detection module that detects a refrigerant temperature at an outlet (hereinafter, also referred to as an outlet temperature) for flowing out from the refrigerant pipe part 22, and sends out an outlet temperature as a detection result thereof to the controller 40 as an outlet temperature signal as needed.

The controller 40 is a controller that integrally controls operations of respective parts of the ice making device 1 in accordance with a computer program or data stored in a memory 40*a*, and includes an input processing part 41, a determination processing part 42, a compressor drive processing part 43, an expansion valve opening processing part 44, and a valve drive processing part 45.

For example, the controller 40 may be implemented by causing a processing device such as a central processing unit (CPU) to execute a computer program, that is, implemented by software, may be implemented by hardware such as an integrated circuit (IC), or implemented by using both of the software and the hardware.

The input processing part 41 receives the inlet temperature sent out from the inlet temperature sensor S1 as the inlet temperature signal, the outlet temperature sent out from the outlet temperature sensor S2 as the outlet temperature signal, and a command given as a command signal from a main controller 49 that integrally controls the operation of the ice making device 1.

The determination processing part 42 determines, in ice making control processing described later, whether the outlet temperature input through the input processing part 41 is equal to or lower than 0° C., or whether the outlet temperature and the inlet temperature input through the input processing part 41 are substantially equal to each other.

The compressor drive processing part 43 sends out a drive command and a drive stop command to the compressor 61 to cause the compressor 61 to work and stop.

The expansion valve opening processing part 44 sends out an opening command to the electronic expansion valve 63 to adjust an opening of the electronic expansion valve 63.

The valve drive processing part 45 sends out an open command or a close command to the first valve 65 and the second valve 67, and causes the first valve 65 and the second valve 67 to be in an opened state or a closed state.

In the ice making device 1 having the configuration as described above, when an ice making command is given from the main controller 49 to be input through the input processing part 41, the controller 40 performs first ice making control processing.

Figure 8:
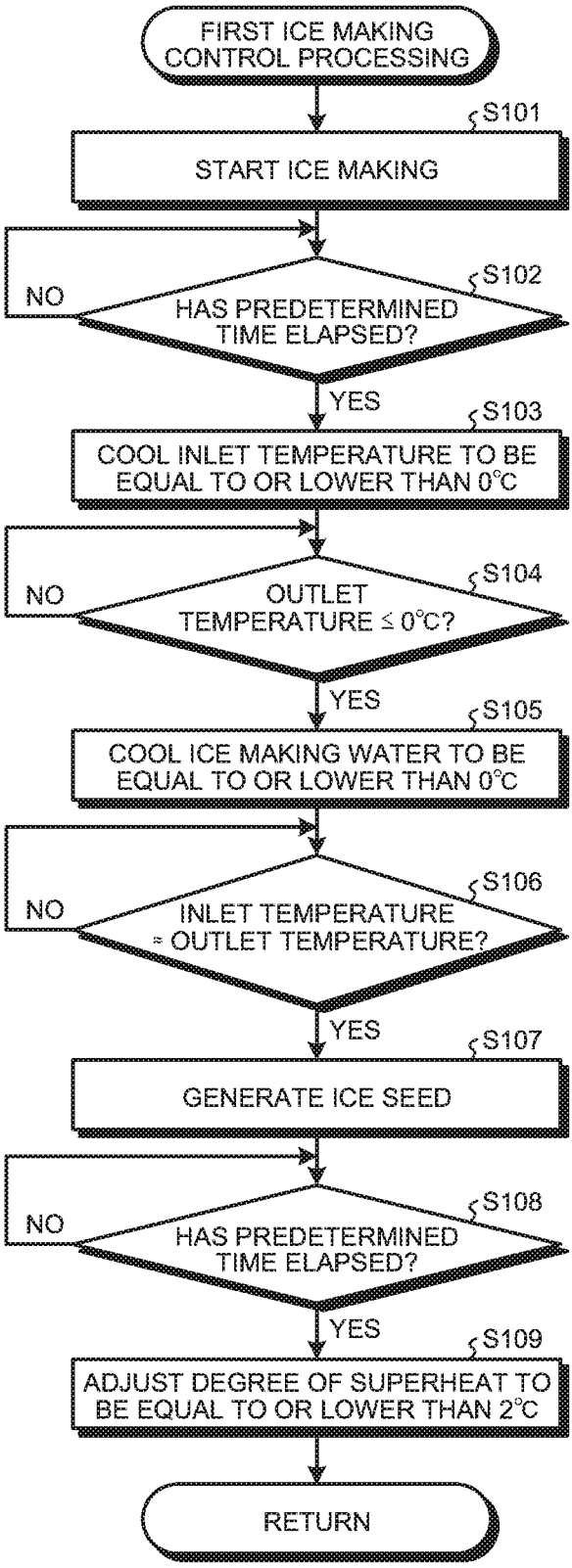
FIG. 8 is a flowchart illustrating processing content of first ice making control processing performed by a controller illustrated in FIG. 2.

FIG. 8 is a flowchart illustrating processing content of the first ice making control processing performed by the controller 40 illustrated in FIG. 2.

As a premise of the description about the first ice making control processing, the first valve 65 is in the opened state and the second valve 67 is in the closed state, water stored in the water storage part 10 is cooled to about 4° C., and the water in the water storage part 10 reaches the upper limit water level and has entered the hollow part 211 as ice making water.

In this first ice making control processing, the controller 40 sends out a drive command to the compressor 61 through the compressor drive processing part 43, and sends out a full-open command to the electronic expansion valve 63 through the expansion valve opening processing part 44 to start ice making (Step S101).

Accordingly, in the refrigerating circuit for ice making 60, the refrigerant compressed by the compressor 61 is condensed by the condenser 62, adiabatically expanded by the electronic expansion valve 63, and passes through each refrigerant passage 221 of the refrigerant pipe part 22. By causing the opening of the electronic expansion valve 63 to be full-opened, a circulation amount of the refrigerant circulating in the refrigerating circuit for ice making 60 is increased, and an amount of the refrigerant passing through the refrigerant pipe part 22 is increased.

If predetermined time has elapsed after starting Step S101 described above (Yes at Step S102), the controller 40 sends out an opening reducing command to the electronic expansion valve 63 through the expansion valve opening processing part 44 in accordance with the inlet temperature that is input through the input processing part 41 as needed, that is, in accordance with reduction in a cooling load in the ice making part 20, and cools the inlet temperature to be equal to or lower than 0° C. (Step S103).

Accordingly, the inlet temperature is lowered in the refrigerant pipe part 22, and the outlet temperature is lowered following the inlet temperature.

After performing Step S103 described above, if it is determined that the outlet temperature input through the input processing part 41 is equal to or lower than 0° C. by the determination processing part 42 (Yes at Step S104), the controller 40 sends out an opening reducing command to the electronic expansion valve 63 through the expansion valve opening processing part 44 in accordance with the inlet temperature that is input through the input processing part 41 as needed, and cools the entire refrigerant pipe part 22 to be equal to or lower than 0° C. while preventing the inlet of the refrigerant pipe part 22 from being excessively cooled to cool the ice making water to be equal to or lower than 0° C. (Step S105).

Accordingly, the ice making water in the hollow part 211 of the ice making part 20 is cooled, and a heat absorption amount is reduced when the temperature becomes equal to or lower than 0° C., so that a degree of superheat as a temperature difference between the inlet temperature and the outlet temperature is reduced.

After performing Step S105 described above, if it is determined that the inlet temperature and the outlet temperature input through the input processing part 41 are close to each other and substantially equal to each other by the determination processing part 42 (Yes at Step S106), the controller 40 sends out an opening reducing command to the electronic expansion valve 63 through the expansion valve opening processing part 44 while increasing the degree of superheat, and maintains the outlet temperature being equal to or lower than 0° C. to produce an ice seed (Step S107).

If predetermined time has elapsed after Step S107 described above is started (Yes at Step S108), the controller 40 sends out an opening increasing command or an opening reducing command to the electronic expansion valve 63 through the expansion valve opening processing part 44 in accordance with the inlet temperature and the outlet temperature that are input through the input processing part 41 as needed to adjust the opening of the electronic expansion valve 63 such that the degree of superheat becomes equal to or lower than 2° C. (Step S109), and returns the procedure thereafter to end this processing.

Accordingly, ice can be produced from the entire ice making water in the ice making part 20 at substantially the same time, and time for producing ice can be prevented from fluctuating.

When an ice block is formed in the hollow part 211 of the ice making main body 21 in the first ice making control processing, the controller 40 sends out a close command to the first valve 65 and sends out an open command to the second valve 67 through the valve drive processing part 45. Accordingly, the refrigerant compressed by the compressor 61 passes through the bypass pipeline 66, and passes through each refrigerant passage 221 of the refrigerant pipe part 22 as hot gas. As a result, the ice making main body 21 is heated, and a boundary portion of the ice block being in contact with an inner wall surface of the hollow part 211 is melted. Thereafter, by causing the ice carrying-out module 30 to work as described later, the ice block in the hollow part 211 can be carried out to a predetermined part through an upper surface opening 211*b* of the hollow part 211. After the ice block is carried out, the compressor 61 is stopped.

As described above, in the ice making device 1 according to the first embodiment of the disclosure, when the ice making command is given, the controller 40 causes the opening of the electronic expansion valve 63 to be full-opened and reduces the opening of the electronic expansion valve 63 in accordance with reduction in the cooling load in the ice making part 20, and adjusts the opening of the electronic expansion valve 63 such that the degree of superheat becomes equal to or lower than 2° C., so that the time for producing ice can be prevented from fluctuating, and the ice is favorably produced by the ice making part 20 while shortening the driving time of the compressor 61.

In the ice making device 1, when the opening of the electronic expansion valve 63 is reduced in accordance with reduction in the cooling load in the ice making part 20 and the degree of superheat comes close to zero, the controller 40 further reduces the opening of the electronic expansion valve 63 to increase the degree of superheat, so that the ice seed can be produced, and the water can be prevented from being left in a supercooled state.

In the ice making device 1, the ice making main body 21 and the refrigerant pipe part 22 included in the ice making part 20 are made of aluminum, so that production cost can be reduced, and heat transfer performance can be improved. The ice making main body 21 is joined to the refrigerant pipe part 22 using the same kind of metal, so that galvanic corrosion and the like are not caused, the galvanic corrosion being problematic in the related art in joining different kinds of metals, that is, copper and stainless steel.

In the ice making device 1 described above, the ice making main body 21 is formed such that a plurality of tubular bodies are continuously arranged, and the refrigerant pipe part 22 has a flat shape in which a plurality of refrigerant passages 221 are arranged in parallel, so that the ice making main body 21 and the refrigerant pipe part 22 can be thermally connected to each other in surface contact, and a heat transfer area can be increased to improve heat transfer efficiency.

In the ice making device 1 having the configuration as described above, when the ice making command signal is given from the main controller 49 and the ice making command is input through the input processing part 41, the controller 40 can perform second ice making control processing as follows.

FIG. 9 is a flowchart illustrating processing content of the second ice making control processing performed by the controller 40 illustrated in FIG. 2.

As a premise of the description about the second ice making control processing, the first valve 65 is in the opened state and the second valve 67 is in the closed state, the water stored in the water storage part 10 is cooled to about 4° C., and the water in the water storage part 10 reaches the upper limit water level and has entered the hollow part 211. Additionally, the pusher member 31 is assumed to be placed at the lower end position.

In the second ice making control processing, the controller 40 sends out a drive command to the compressor 61, and starts to measure time with an incorporated clock (Step S201 and Step S202). Accordingly, in the refrigerating circuit for ice making 60, the refrigerant compressed by the compressor 61 is condensed by the condenser 62, adiabatically expanded by the electronic expansion valve 63, and passes through each refrigerant passage 221 of the refrigerant pipe part 22 thereafter. When the refrigerant passing through each refrigerant passage 221 evaporates, the ice making main body 21 is cooled to below the freezing point. In this way, when the ice making main body 21 is cooled to below the freezing point, upper part of the water stored in the water storage part 10 that has entered the hollow part 211 is cooled. It is known that density of water in a solid state is smaller than that in a liquid state, so that the density of the upper part of the water stored in the water storage part 10 is considered to be small. The density of the water cooled by the ice making main body 21 is further reduced, and the water concentrates at an upper part.

Figure 10:
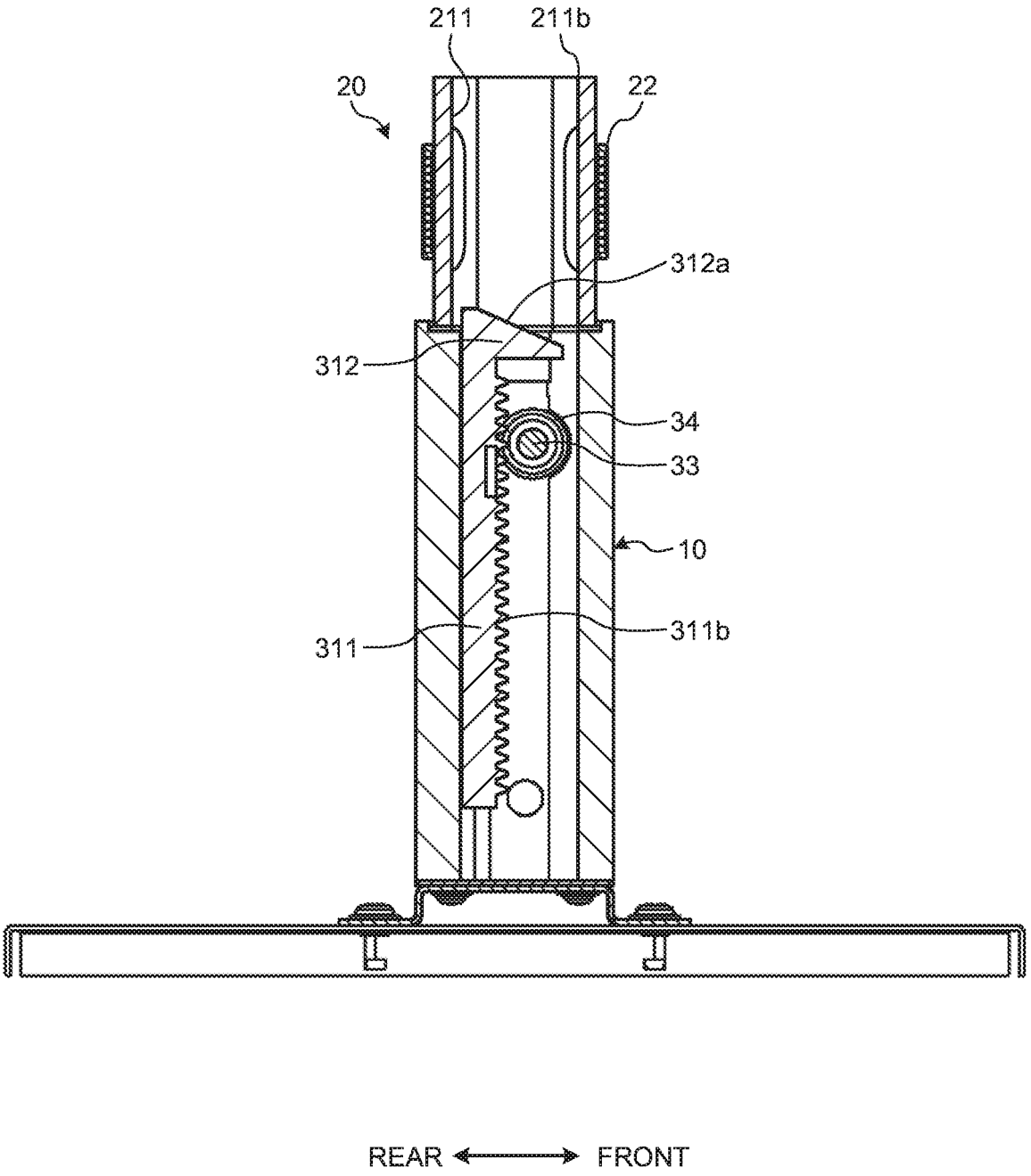
FIG. 10 is a vertical cross-sectional view schematically illustrating a principal part of the ice making device illustrated in FIG. 1.

The controller 40 that has performed Step S201 and Step S202 repeats processing of sending out the drive command to the water supply pump 51 to work, and sending out the drive stop command to the water supply pump 51 to stop the operation until predetermined ice making time has elapsed (Step S203, Step S204, and No at Step S205). In this way, by repeatedly causing the water supply pump 51 to work and stop until the ice making time elapses, the water level of the water stored in the water storage part 10 fluctuates, and the water in the ice making part 20 flows. Accordingly, at Step S201 described above, the water is frozen and ice is produced to be gradually grown as illustrated in FIG. 10 in the vicinity of the inner wall surface of the hollow part 211 of the ice making main body 21. When a flow speed of the water is changed, air bubbles included in the water can be removed in such a frozen process. That is, the controller 40 and the water supply pump 51 constitute a water flowing module that causes the water in the ice making part 20 to flow during a period in which the ice is produced by the ice making part 20.

Figure 11:
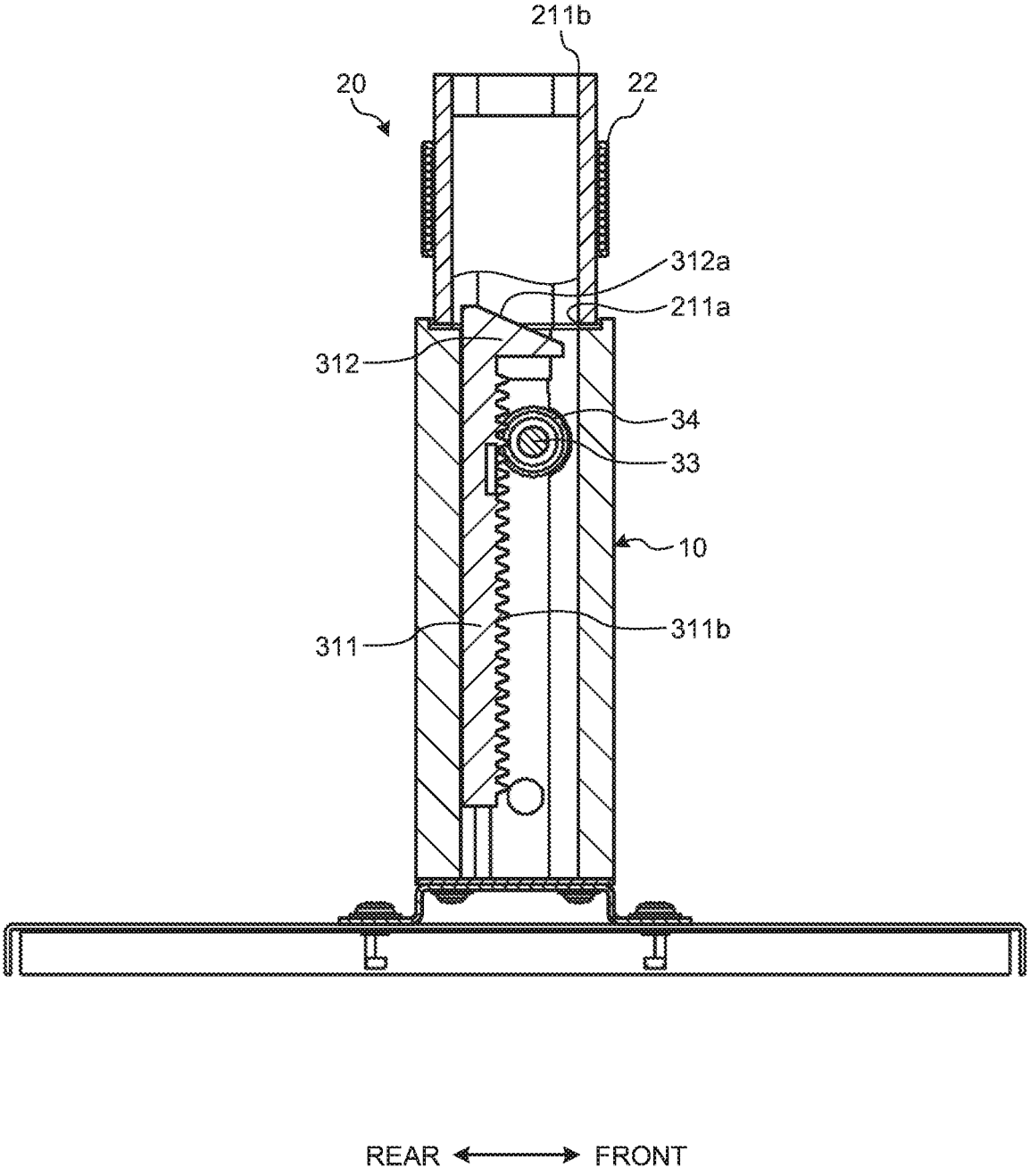
FIG. 11 is a vertical cross-sectional view schematically illustrating a principal part of the ice making device illustrated in FIG. 1.

When the time started to be measured at Step S202 reaches the ice making time, an ice block is formed in the hollow part 211 of the ice making main body 21 as illustrated in FIG. 11. Thus, when the ice making time has elapsed (Yes at Step S205), the controller 40 ends measurement of the time with the clock, sends out the close command to the first valve 65, and sends out the open command to the second valve 67 (Step S206 and Step S207).

Accordingly, the refrigerant compressed by the compressor 61 passes through the bypass pipeline 66, and passes through each refrigerant passage 221 of the refrigerant pipe part 22 as hot gas. As a result, the ice making main body 21 is heated, and a boundary portion of the ice block being in contact with the inner wall surface of the hollow part 211 is melted.

The controller 40 that has performed the processing at Step S207 described above sends out a normal rotation drive command to the motor 321 (Step S208). In this way, when the motor 321 works to normally rotate, the shaft part 33 to which rotational driving force thereof is transmitted via the transmission unit 322 is rotated in a clockwise direction when viewed from the left. In this way, when the shaft part 33 rotates in the clockwise direction when viewed from the left and then the transmission part 34 also rotates in the clockwise direction when viewed from the left, the pusher member 31 engaging with the transmission part 34 moves upward from the lower end position to pass through the hollow part 211. In this way, when the pusher member 31 moves upward, the ice block formed in the hollow part 211 can be pressed upward to be moved, the boundary portion of the ice block with respect to the ice making main body 21 being melted.

Figure 12:
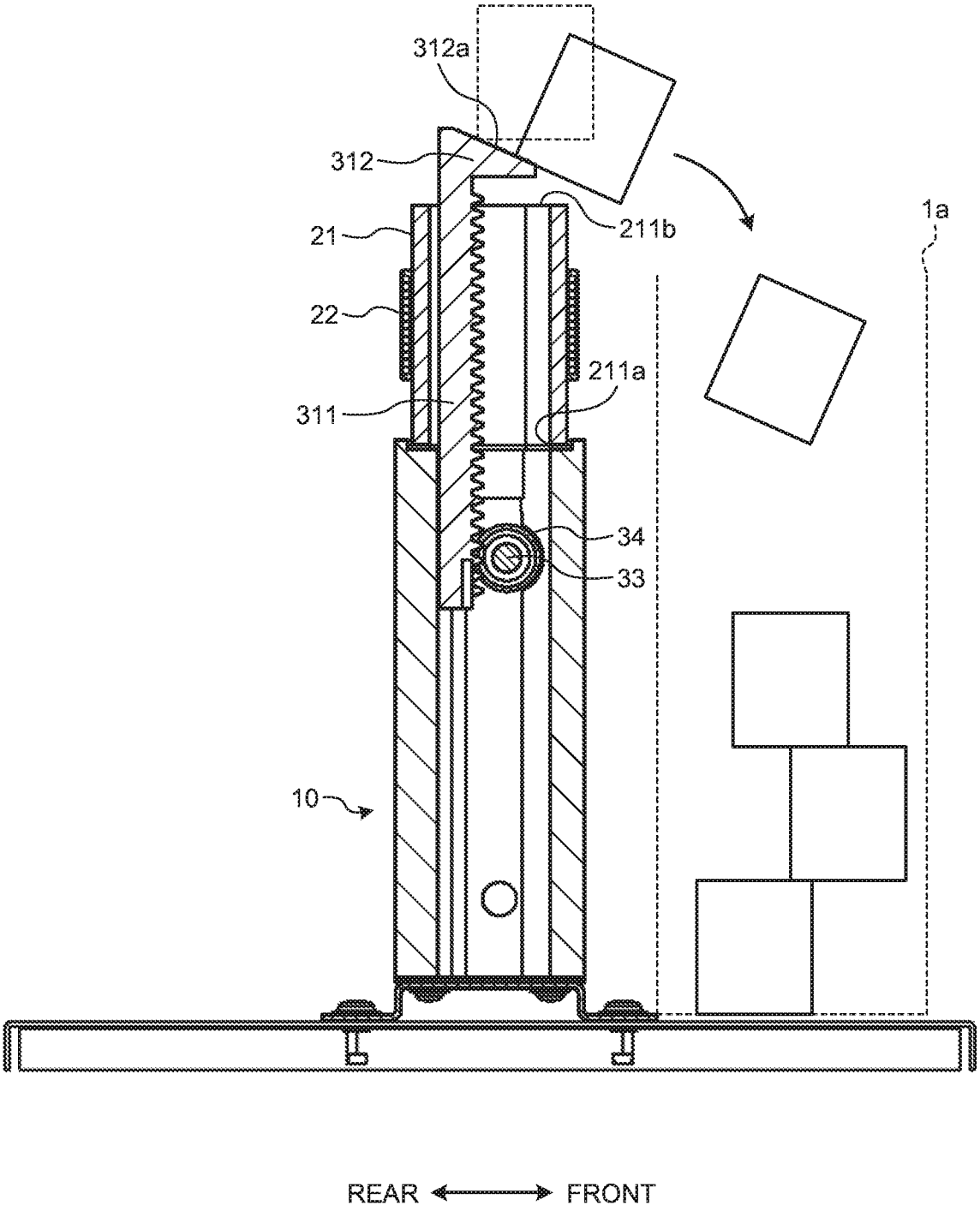
FIG. 12 is a vertical cross-sectional view schematically illustrating a principal part of the ice making device illustrated in FIG. 1.

If a detection signal is given from the pusher position detection part 322*a*, the detection signal indicating the fact that the pusher member 31 is arranged at the upper end position protruding upward from the upper surface opening 211*b* of the hollow part 211 as illustrated in FIG. 12 (Yes at Step S209), the controller 40 sends out a reverse rotation drive command to the motor 321 (Step S210).

When the pusher member 31 is arranged at the upper end position, the ice block that has moved upward together with the pusher member 31 moves forward in accordance with inclination of the upper surface 312*a* of the upper end part 312 in the pusher member 31, and is put in an ice storage part 1*a* for storing the ice as ice to be stored. That is, the ice carrying-out module 30 carries out the ice produced by the ice making part 20 to the ice storage part 1*a*.

When the motor 321 works to reversely rotate, the shaft part 33 to which the rotational driving force thereof is transmitted via the transmission unit 322 is rotated in a counterclockwise direction when viewed from the left. In this way, when the shaft part 33 rotates in the counterclockwise direction when viewed from the left and then the transmission part 34 also rotates in the counterclockwise direction when viewed from the left, the pusher member 31 engaging with the transmission part 34 moves downward from the upper end position.

As illustrated in FIG. 7, if a detection signal is given from the pusher position detection part 322*a*, the detection signal indicating the fact that the pusher member 31 is arranged at the lower end position to substantially block the lower surface opening 211*a* of the hollow part 211 with the upper end part 312 (Yes at Step S211), the controller 40 sends out the drive stop command to the motor 321 (Step S212) to stop the motor 321. That is, when a carry-out command is given, the ice carrying-out module 30 moves the pusher member 31 to the upper end position from the lower end position, and then moves the pusher member 31 to the lower end position.

The controller 40 that has sent out the drive stop command to the motor 321 sends out the open command to the first valve 65 and sends out the close command to the second valve 67 (Step S213), cools the ice making main body 21, sends out a drive command to the water supply pump 51 thereafter, and waits for an input of a signal indicating that the upper limit water level is reached from the water level sensor S3 (Step S214 and Step S215).

If the signal indicating that the upper limit position is reached is given from the water level sensor S3 (Yes at Step S215), the controller 40 sends out a drive stop command to the water supply pump 51 (Step S216).

The controller 40 then repeats the processing from Step S202 to Step S216 until an ice making stop command is given from a host appliance (No at Step S217). Accordingly, processing for producing ice by intensively cooling upper part of the water stored in the water storage part 10 is repeatedly performed.

If the ice making stop command is given from the host appliance (Yes at Step S217), the controller 40 sends out the drive stop command to the compressor 61 (Step S218), and returns the procedure thereafter to end this processing.

In the ice making device 1 described above, the ice making part 20 cools upper part of the water stored in the water storage part 10 to produce ice, so that the ice can be produced by intensively cooling the water having small density immediately before being frozen, and it is not necessary to cool the whole water stored in the water storage part 10 up to a temperature immediately before being frozen. Due to this, heat loss can be reduced, and power consumption required for cooling the water can also be reduced. Accordingly, cooling efficiency can be improved to save energy.

In the ice making device 1 described above, when the pusher member 31 constituting the ice carrying-out module 30 is arranged at the lower end position, the lower surface opening 211*a* of the hollow part 211 of the ice making main body 21 is substantially blocked by the upper end part 312, so that the water that has entered the hollow part 211 can be partitioned from the other part of water stored in the water storage part 10. Thus, the ice can be produced by intensively cooling the water that has entered the hollow part 211, and it is not necessary to cool the whole water stored in the water storage part 10 up to a temperature immediately before being frozen. Due to this, heat loss can be reduced, and power consumption required for cooling the water can also be reduced. Accordingly, cooling efficiency can be improved to save energy.

In the ice making device 1 described above, the upper surface 312*a* of the upper end part 312 of the pusher member 31 gradually inclines downward toward the front, so that the ice can be put in the ice storage part 1*a* only by arranging the pusher member 31 at the upper end position projecting upward from the upper surface opening 211*b* of the hollow part 211, and it is sufficient only to move the pusher member 31 along the vertical direction, which simplifies the device configuration.

In the ice making device 1, the pusher members 31 are engaged with the same shaft part 33 via the transmission part 34, and driven by the motor 321 as a common driving source, so that the number of components can be reduced as compared with a case in which a driving source is individually coupled to each of the pusher members 31, and the production cost can be reduced.

With the ice making device 1 described above, the controller 40 repeatedly causes the water supply pump 51 to work and stop until the ice making time elapses to cause the water level of the water stored in the water storage part 10 to fluctuate to cause the water in the ice making part 20 to flow, so that air bubbles included in the water can be removed when the water is frozen by changing the flow speed of the water in the ice making part 20.

Accordingly, transparent ice can be produced.

Second Embodiment

Figure 13:
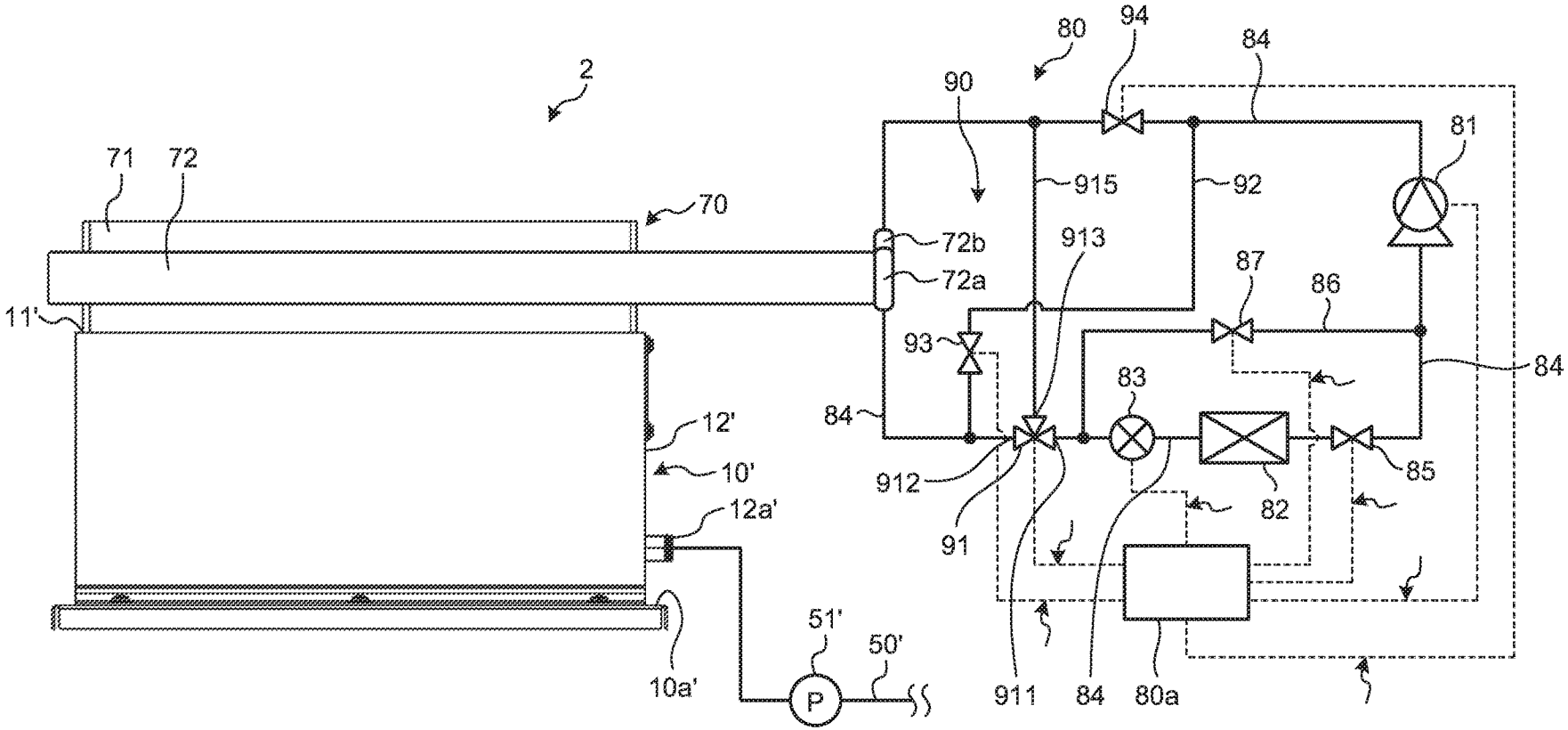
FIG. 13 is a schematic diagram schematically illustrating an ice making device according to a second embodiment of the disclosure.

FIG. 13 is a schematic diagram schematically illustrating an ice making device according to a second embodiment of the disclosure. An ice making device 2 exemplified herein includes a water storage part 10' and an ice making part 70.

Figure 14:
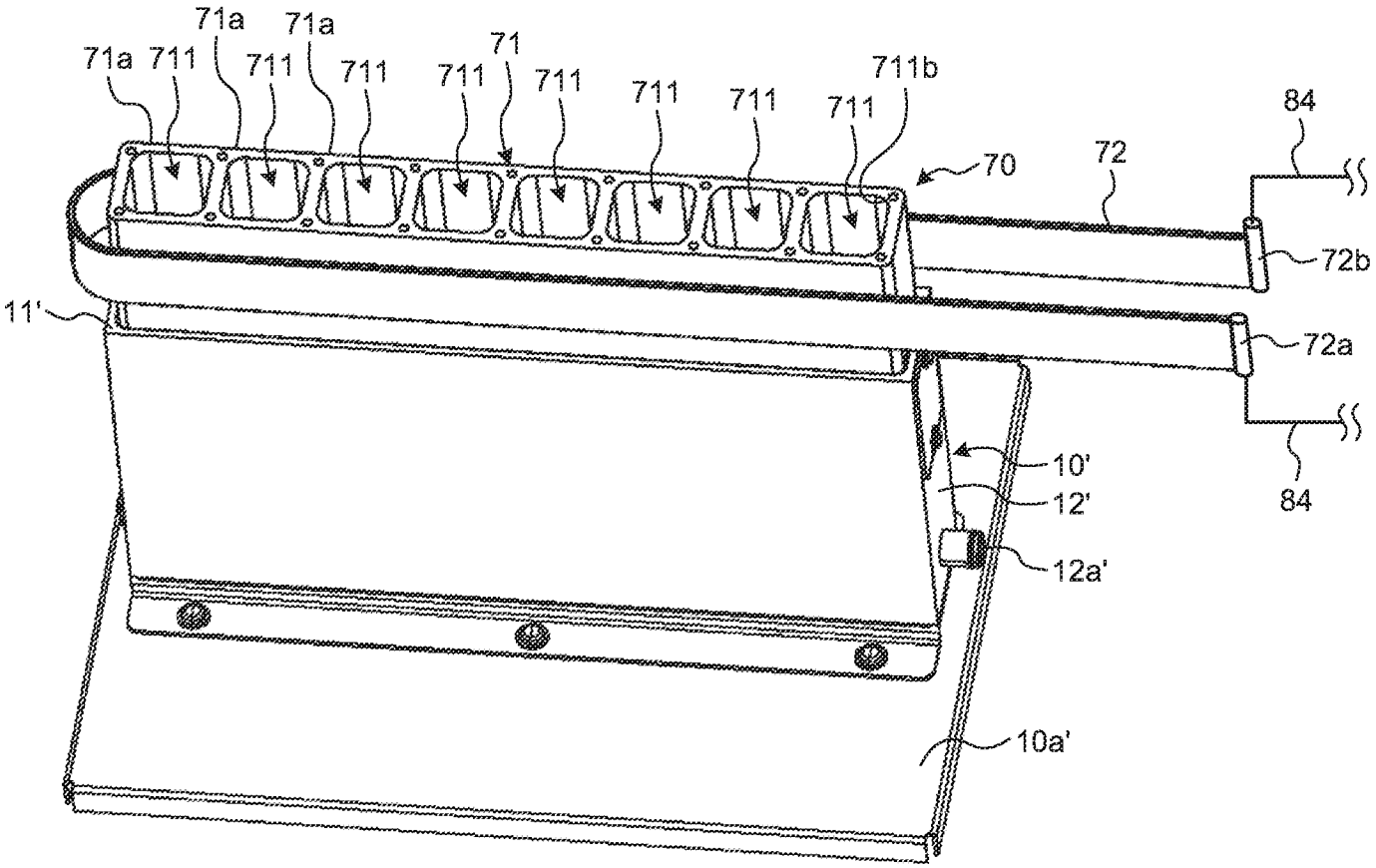
FIG. 14 is a perspective view illustrating an enlarged principal part of the ice making device illustrated in FIG. 13.

The water storage part 10' is placed on a base 10*a*' as illustrated in FIG. 14, and has a rectangular parallelepiped shape in which a plurality of (eight) upper wall openings are arranged side by side on an upper wall part 11' (not illustrated). An introduction port 12*a*' is formed on a right wall part 12' of the water storage part 10', and the water storage part 10' is connected to a water supply line 50' via the introduction port 12*a*'.

The water supply line 50' is a path for supplying water to the water storage part 10', and a water supply pump 51' is arranged in the middle thereof. When working, the water supply pump 51' constitutes a water supply module that supplies water to the water storage part 10' via the water supply line 50'. A cooling module (not illustrated) for cooling the water to be stored is arranged in the water storage part 10', and the water to be stored is cooled to about 4° C., for example, by the cooling module.

The ice making part 70 includes an ice making main body 71 and a refrigerant pipe part 72. The ice making main body 71 is made of aluminum. The ice making main body 71 is configured such that a plurality of (eight) tubular bodies 71*a* each having a hollow part 711 extending in the vertical direction are continuously arranged side by side. The ice making main body 71 is placed on the upper wall part 11' such that a lower surface opening 711*a* (refer to FIG. 15) of each hollow part 711 communicates with a corresponding upper wall opening. Herein, the front and rear width and the left and right width of the hollow part 711 are substantially equal to the front and rear width and the left and right width of the upper wall opening.

Figure 15:
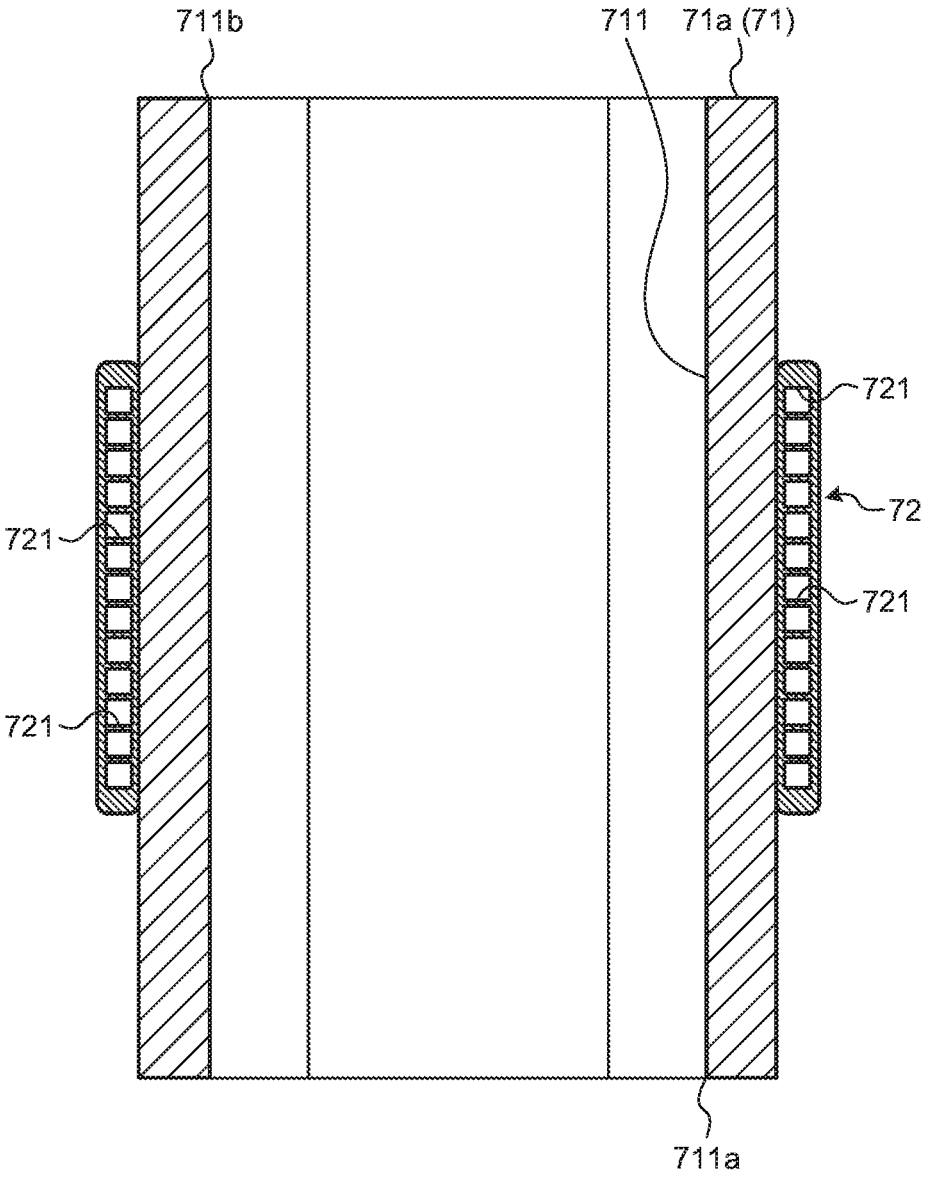
FIG. 15 is a vertical cross-sectional view of the ice making part illustrated in FIGS. 13 and 14.

Similarly to the ice making main body 71 described above, the refrigerant pipe part 72 is made of aluminum. As illustrated in FIG. 15, the refrigerant pipe part 72 is a flat perforated tube in which a plurality of refrigerant passages 721 are arranged in parallel. The refrigerant pipe part 72 is arranged around the ice making main body 71 in a state in which an inner face thereof is thermally connected to a front face and a rear face of the ice making main body 71. A first header 72*a* is arranged at one end part of the refrigerant pipe part 72 so as to communicate with each refrigerant passage 721, and a second header 72*b* is arranged at the other end part thereof so as to communicate with each refrigerant passage 721.

The refrigerant pipe part 72 described above constitutes, as an evaporator, a refrigerating circuit for ice making 80 together with a compressor 81, a condenser 82, and an electronic expansion valve 83. The refrigerating circuit for ice making 80 is configured by sequentially connecting the compressor 81, the condenser 82, the electronic expansion valve 83, and the refrigerant pipe part (evaporator) 72 via a refrigerant pipeline 84, and encloses the refrigerant therein. The refrigerant pipeline 84 is configured with a single piece of refrigerant piping, or configured by connecting a plurality of pieces of refrigerant piping.

A suction part of the compressor 81 is connected to the second header 72*b* via the refrigerant pipeline 84, and the compressor 81 works when receiving a drive command from an controller 80*a* as a control module. When working, the compressor 81 suctions and compresses the refrigerant from the refrigerant pipe part 72, and discharges the compressed refrigerant through a discharging part.

The controller 80*a* integrally controls operations of respective parts of the refrigerating circuit for ice making 80. For example, the controller 80*a* may be implemented by causing a processing device such as a central processing unit (CPU) to execute a computer program, that is, implemented by software, may be implemented by hardware such as an integrated circuit (IC), or implemented by using both of the software and the hardware.

An inlet of the condenser 82 is connected to the discharging part of the compressor 81 via the refrigerant pipeline 84. The condenser 82 exchanges heat of the refrigerant discharged from the compressor 81 with heat of the ambient air, and causes the refrigerant to be condensed. A first valve 85 is arranged in the middle of the refrigerant pipeline 84 connecting the compressor 81 with the condenser 82.

The first valve 85 is a valve body that opens and closes in response to a command given from the controller 80*a*, which allows the refrigerant discharged from the compressor 81 to pass therethrough toward the condenser 82 in the opened state, and regulates passage of the refrigerant discharged from the compressor 81 toward the condenser 82 in the closed state.

An inlet side of the electronic expansion valve 83 is connected to an outlet of the condenser 82 via the refrigerant pipeline 84, and an outlet side thereof is connected to the refrigerant pipe part 72 via the refrigerant pipeline 84. The electronic expansion valve 83 has an opening that is adjusted in accordance with a command given from the controller 80*a*, and decompresses the refrigerant condensed by the condenser 82 to be adiabatically expanded.

In the refrigerating circuit for ice making 80, a bypass pipeline 86 and a switching unit 90 are arranged.

The bypass pipeline 86 is arranged to join the middle of the refrigerant pipeline 84 connecting the electronic expansion valve 83 with the refrigerant pipe part 72, the bypass pipeline 86 being branched from an upstream side of the first valve 85 in the refrigerant pipeline 84 connecting the compressor 81 with the condenser 82. A second valve 87 is arranged in the middle of the bypass pipeline 86.

The second valve 87 is a valve body that opens and closes in response to a command given from the controller 80*a*, which allows the refrigerant discharged from the compressor 81 to pass through the bypass pipeline 86 toward the refrigerant pipe part 72 in the opened state, and regulates passage of the refrigerant discharged from the compressor 81 through the bypass pipeline 86 in the closed state.

The switching unit 90 includes a cross valve 91, a communication pipeline 92, a first switching valve 93, and a second switching valve 94.

The cross valve 91 is arranged in the middle of the refrigerant pipeline 84 connecting the electronic expansion valve 83 with the refrigerant pipe part 72, and being closer to the refrigerant pipe part 72 than a joining point of the bypass pipeline 86. The cross valve 91 includes an inlet part 911 and two outlet parts 912 and 913. The inlet part 911 is connected to the refrigerant pipeline 84 that is connected to the outlet side of the electronic expansion valve 83. The first outlet part 912 out of the two outlet parts 912 and 913 is connected to the refrigerant pipe part 72, and the second outlet part 913 is connected to a switching pipeline 915. One end of the switching pipeline 915 is connected to the second outlet part 913, and the other end thereof is connected to a middle point of the refrigerant pipeline 84 connecting the refrigerant pipe part 72 with the compressor 81.

The cross valve 91 is a valve that can be alternatively switched between a first communication state in which the inlet part 911 is caused to communicate with the first outlet part 912 and the refrigerant decompressed by the electronic expansion valve 83 is sent out to the refrigerant pipe part 72, and a second communication state in which the inlet part 911 is caused to communicate with the second outlet part 913 and the refrigerant decompressed by the electronic expansion valve 83 is sent out to the switching pipeline 915. Such a switching operation of the cross valve 91 is performed in accordance with a command given from the controller 80*a*.

The communication pipeline 92 is arranged being branched from a downstream side of the cross valve 91 in the refrigerant pipeline 84 connecting the cross valve 91 with the refrigerant pipe part 72 to join the refrigerant pipeline 84 connecting the refrigerant pipe part 72 with the compressor 81 at a point closer to the compressor 81 than a connection point of the switching pipeline 915.

The first switching valve 93 is arranged in the middle of the communication pipeline 92. The first switching valve 93 is a valve body that opens and closes in response to a command given from the controller 80*a*, which allows the refrigerant to pass through the communication pipeline 92 in the opened state, and regulates passage of the refrigerant through the communication pipeline 92 in the closed state.

The second switching valve 94 is arranged between a connection point of the switching pipeline 915 and a joining point of the communication pipeline 92 in the refrigerant pipeline 84 connecting the refrigerant pipe part 72 with the compressor 81. The second switching valve 94 is a valve body that opens and closes in response to a command given from the controller 80*a*, which allows the refrigerant to pass through an arrangement point of the second switching valve 94 in the opened state, and regulates passage of the refrigerant through the arrangement point in the closed state.

The ice making device 2 having the configuration as described above produces ice as follows. It is assumed that the water stored in the water storage part 10' is cooled to about 4° C., and the water in the water storage part 10' reaches the upper limit water level and has entered the hollow part 711 as ice making water.

When receiving the ice making command, the controller 80*a* causes the first valve 85 to be in the opened state and causes the second valve 87 to be in the closed state, and causes the compressor 81 to work while causing the electronic expansion valve 83 to have a predetermined opening. Regarding the switching unit 90, the controller 80*a* causes the cross valve 91 to be in the first communication state, causes the first switching valve 93 to be in the closed state, and causes the second switching valve 94 to be in the opened state to cause a first sending-out state.

Figure 16:
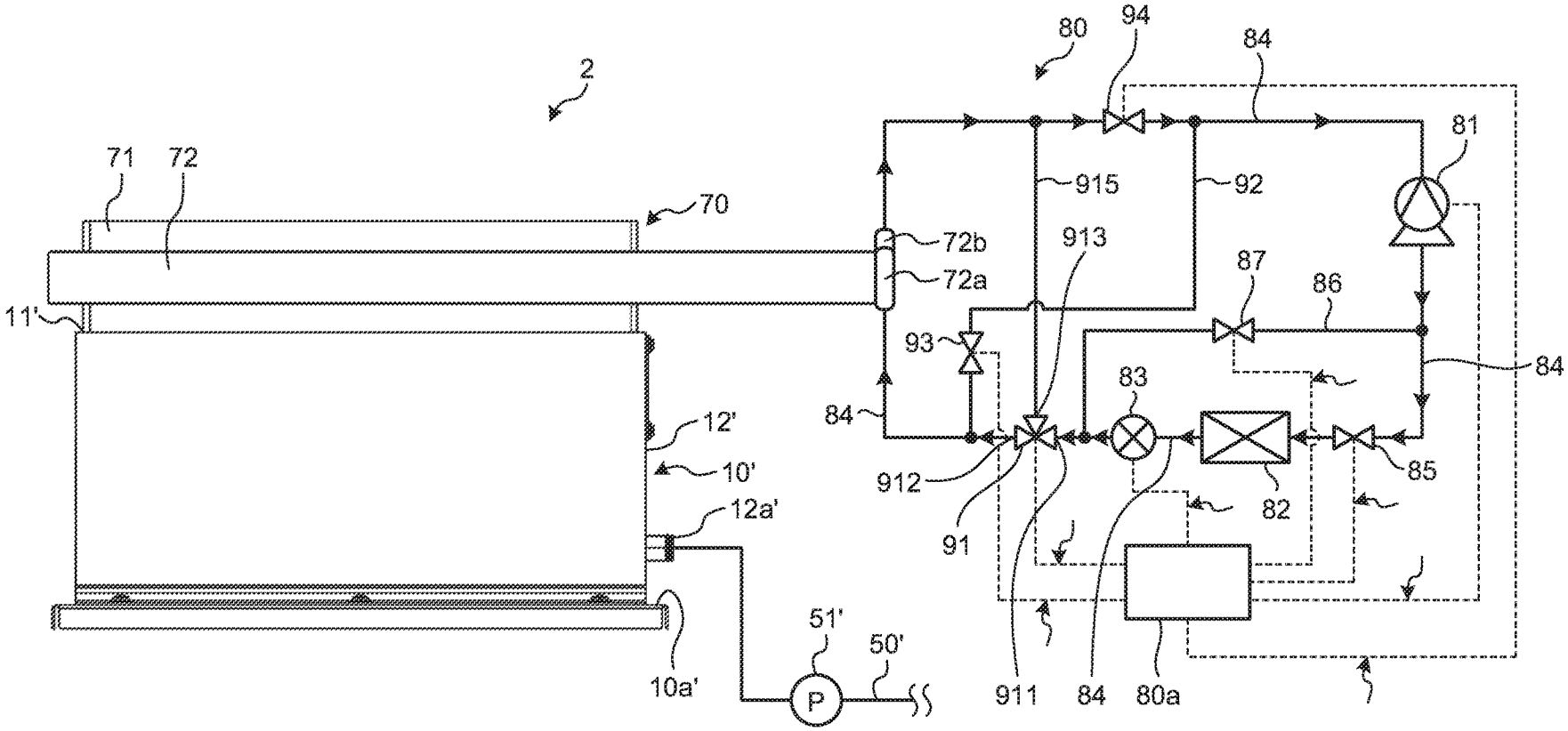
FIG. 16 is a schematic diagram illustrating a flow of a refrigerant in a refrigerating circuit for ice making illustrated in FIG. 13.

Accordingly, in the refrigerating circuit for ice making 80, as illustrated in FIG. 16, the refrigerant compressed by the compressor 81 is condensed by the condenser 82, adiabatically expanded by the electronic expansion valve 83, and reaches the first header 72*a* of the refrigerant pipe part 72. That is, by causing the switching unit 90 to be in the first sending-out state, the refrigerant decompressed by the electronic expansion valve 83 is sent out to the first header 72*a* (one end part) of the refrigerant pipe part 72.

In the refrigerant pipe part 72, the refrigerant that has flowed in through the first header 72*a* passes through each refrigerant passage 721 to cool the ice making main body 71 that is thermally connected thereto. That is, in the refrigerant pipe part 72, when the refrigerant adiabatically expanded by the electronic expansion valve 83 passes through each refrigerant passage 721, the refrigerant evaporates to cool the ice making main body 71. The refrigerant that has passed through each refrigerant passage 721 reaches the second header 72*b*, and is discharged from the second header 72*b* to be suctioned by the compressor 81.

When the switching unit 90 is caused to be in the first sending-out state and predetermined time has elapsed, the controller 80*a* causes the cross valve 91 of the switching unit 90 to be in the second communication state, causes the first switching valve 93 thereof to be in the opened state, and causes the second switching valve 94 thereof to be in the closed state to cause a second sending-out state.

Figure 17:
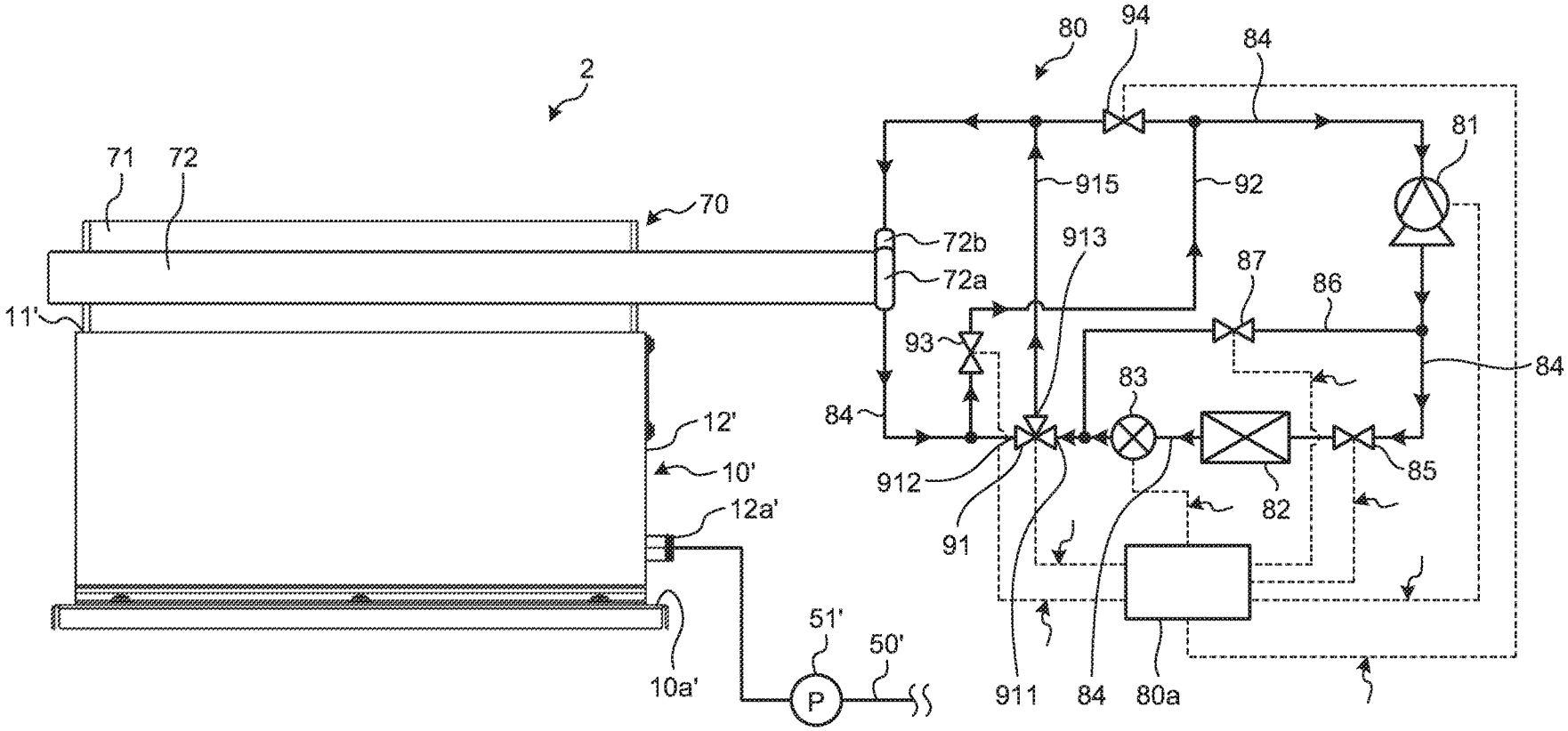
FIG. 17 is a schematic diagram illustrating a flow of a refrigerant in the refrigerating circuit for ice making illustrated in FIG. 13.

Accordingly, in the refrigerating circuit for ice making 80, as illustrated in FIG. 17, the refrigerant compressed by the compressor 81 is condensed by the condenser 82, adiabatically expanded by the electronic expansion valve 83, and passes through the cross valve 91 and the switching pipeline 915 to reach the second header 72*b* of the refrigerant pipe part 72. That is, by causing the switching unit 90 to be in the second sending-out state, the refrigerant decompressed by the electronic expansion valve 83 is sent out to the second header 72*b* (other end part) of the refrigerant pipe part 72.

In the refrigerant pipe part 72, the refrigerant that has flowed in through the second header 72*b* passes through each refrigerant passage 721 to cool the ice making main body 71 that is thermally connected thereto. That is, in the refrigerant pipe part 72, when the refrigerant adiabatically expanded by the electronic expansion valve 83 passes through each refrigerant passage 721, the refrigerant evaporates to cool the ice making main body 71 to below the freezing point. The refrigerant that has passed through each refrigerant passage 721 reaches the first header 72*a*, is discharged from the first header 72*a*, passes through the communication pipeline 92 from the middle point of the refrigerant pipeline 84, and is suctioned by the compressor 81.

When predetermined time has elapsed after causing the switching unit 90 to be in the second sending-out state, the controller 80*a* causes the switching unit 90 to be in the first sending-out state, and repeatedly and alternately switches between the first sending-out state and the second sending-out state of the switching unit 90 every time a predetermined time has elapsed until the ice making stop command is given. Accordingly, the entire refrigerant pipe part 72 is cooled to be equal to or lower than 0° C., so that the ice making water can be cooled to be equal to or lower than 0° C.

In this way, by switching between the first sending-out state and the second sending-out state of the switching unit 90 every time a predetermined time has elapsed, the inlet and the outlet of the refrigerant are alternately replaced with each other in the refrigerant pipe part 72 as an evaporator. Accordingly, a sufficiently cooled refrigerant can be uniformly passed through each refrigerant passage 721 of the refrigerant pipe part 72, and the degree of superheat as a temperature difference between the inlet temperature and the outlet temperature can be minimized, that is, caused to be close to zero.

Due to this, the ice can be produced from the whole ice making water in the ice making part 70 at substantially the same time, and the time for producing ice can be prevented from fluctuating.

Figure 18:
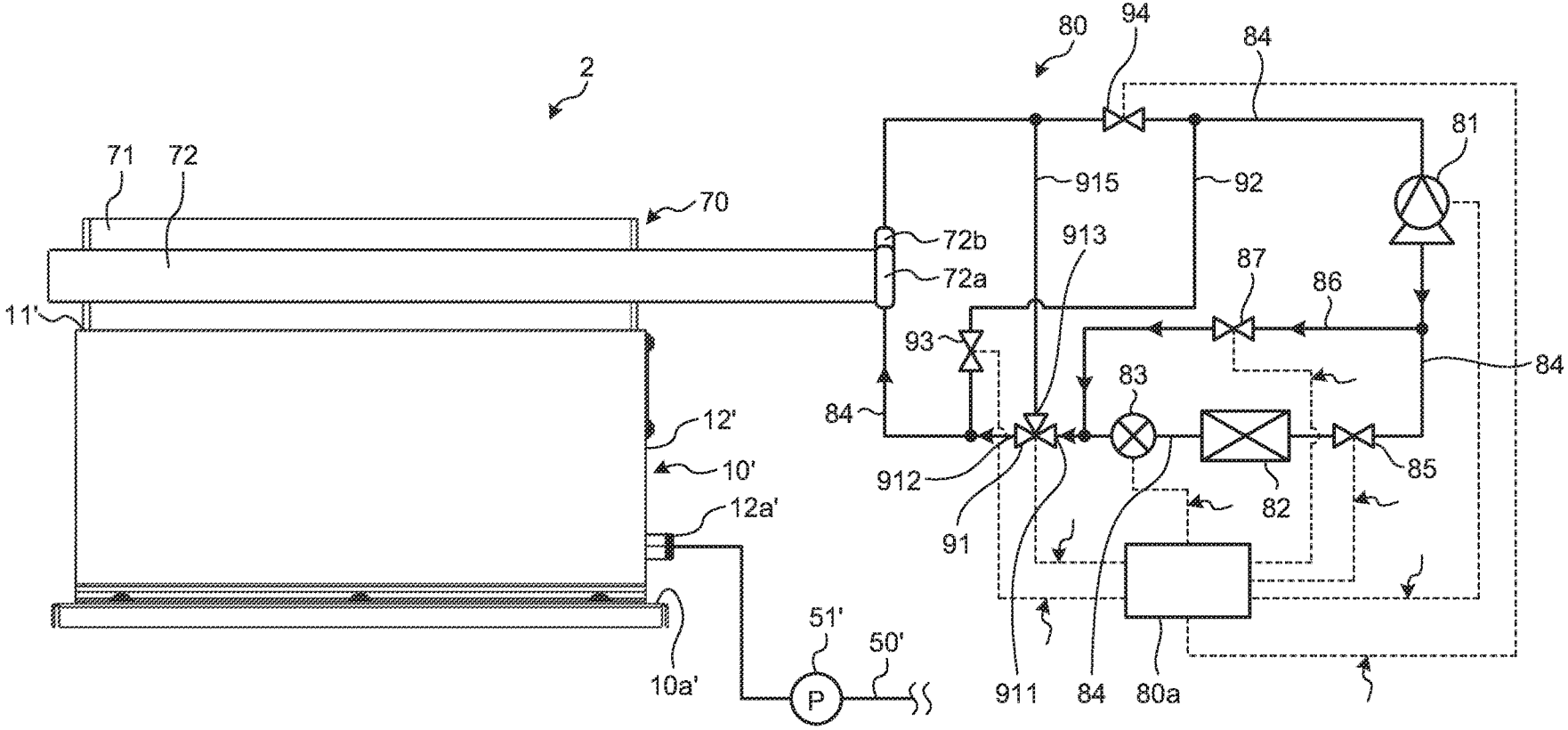
FIG. 18 is a schematic diagram illustrating a flow of a refrigerant in the refrigerating circuit for ice making illustrated in FIG. 13.

When the ice block is formed in the hollow part 711 of the ice making main body 71 as described above, the controller 80*a* causes the switching unit 90 to be in the first sending-out state, causes the first valve 85 to be in the closed state, and causes the second valve 87 to be in the opened state. Accordingly, as illustrated in FIG. 18, the refrigerant compressed by the compressor 81 passes through the bypass pipeline 86, and passes through each refrigerant passage 721 of the refrigerant pipe part 72 as hot gas. As a result, the ice making main body 71 is heated, and a boundary portion of the ice block being in contact with the inner wall surface of the hollow part 711 is melted. Thereafter, by causing the ice carrying-out module (30) (not illustrated) to work, the ice block in the hollow part 711 can be carried out to a predetermined part through an upper surface opening 711*b* of the hollow part 711. After the ice block is carried out, the compressor 81 is stopped to end production of the ice.

In the second embodiment, the controller 80*a* and the switching unit 90 constitute a switch that is switched for each predetermined time between the first sending-out state in which the refrigerant decompressed by the electronic expansion valve 83 is sent out to the first header 72*a* as one end part of the refrigerant pipe part 72, and the second sending-out state in which the refrigerant decompressed by the electronic expansion valve 83 is sent out to the second header 72*b* as the other end part of the refrigerant pipe part 72.

As described above, in the ice making device 2 according to the second embodiment of the disclosure, the controller 80*a* and the switching unit 90 are switched for each predetermined time between the first sending-out state in which the refrigerant decompressed by the electronic expansion valve 83 is sent out to the first header 72*a* as one end part of the refrigerant pipe part 72, and the second sending-out state in which the refrigerant decompressed by the electronic expansion valve 83 is sent out to the second header 72*b* as the other end part of the refrigerant pipe part 72, so that the degree of superheat as a temperature difference between the inlet temperature and the outlet temperature in the refrigerant pipe part 72 can be minimized, and the time for producing ice can be prevented from fluctuating. Accordingly, the ice can be favorably produced by the ice making part 70, and driving time of the compressor 81 can be shortened.

In the ice making device 2 described above, the ice making main body 71 and the refrigerant pipe part 72 constituting the ice making part 70 are made of aluminum, so that the production cost can be reduced and the heat transfer performance can be improved. Additionally, the ice making main body 71 is joined to the refrigerant pipe part 72 using the same kind of metal, so that galvanic corrosion and the like are not caused, the galvanic corrosion being problematic in the related art in joining different kinds of metals, that is, copper and stainless steel.

In the ice making device 2, the ice making main body 71 is formed such that a plurality of tubular bodies 71*a* are continuously arranged, and the refrigerant pipe part 72 has a flat shape in which a plurality of refrigerant passages 721 are arranged in parallel, so that the ice making main body 71 and the refrigerant pipe part 72 can be thermally connected to each other in surface contact, and a heat transfer area can be increased to improve heat transfer efficiency.

Third Embodiment

Figure 19:
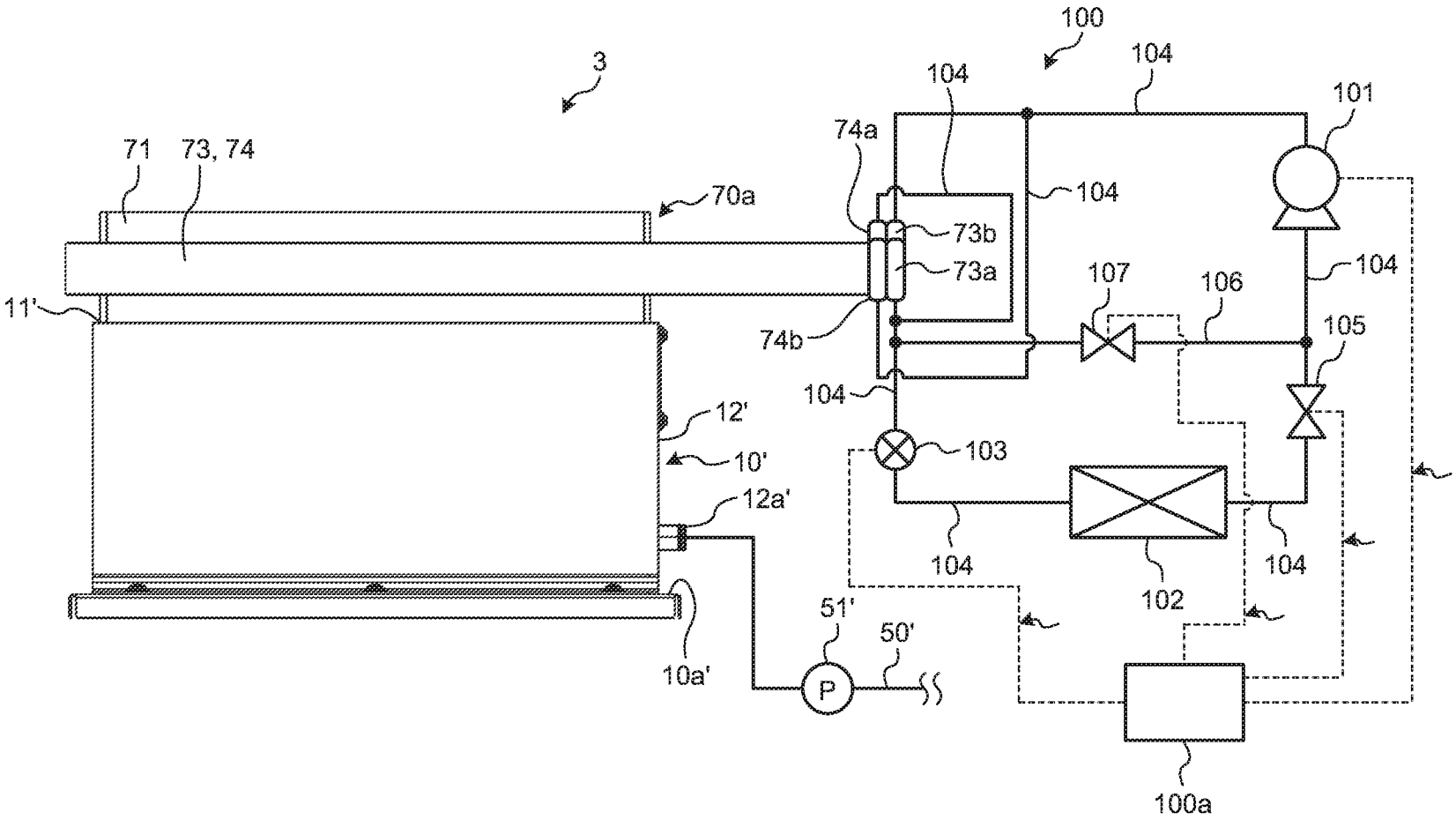
FIG. 19 is a schematic diagram schematically illustrating an ice making device according to a third embodiment of the disclosure.

FIG. 19 is a schematic diagram schematically illustrating an ice making device according to a third embodiment of the disclosure. The same component as that in the second embodiment described above is denoted by the same reference numeral, and redundant description will not be repeated. An ice making device 3 exemplified herein includes the water storage part 10' and an ice making part 70*a*.

The ice making part 70*a* includes the ice making main body 71, a first refrigerant pipe part 73, and a second refrigerant pipe part 74. The ice making main body 71 is made of aluminum. The ice making main body 71 is configured such that a plurality of (eight) tubular bodies 71*a* each having a hollow part 711 extending in the vertical direction are continuously arranged side by side. The ice making main body 71 is placed on the upper wall part 11' such that the lower surface opening 711*a* (refer to FIG. 20) of each hollow part 711 communicates with a corresponding upper wall opening. Herein, the front and rear width and the left and right width of the hollow part 711 are substantially equal to the front and rear width and the left and right width of the upper wall opening.

Figure 20:
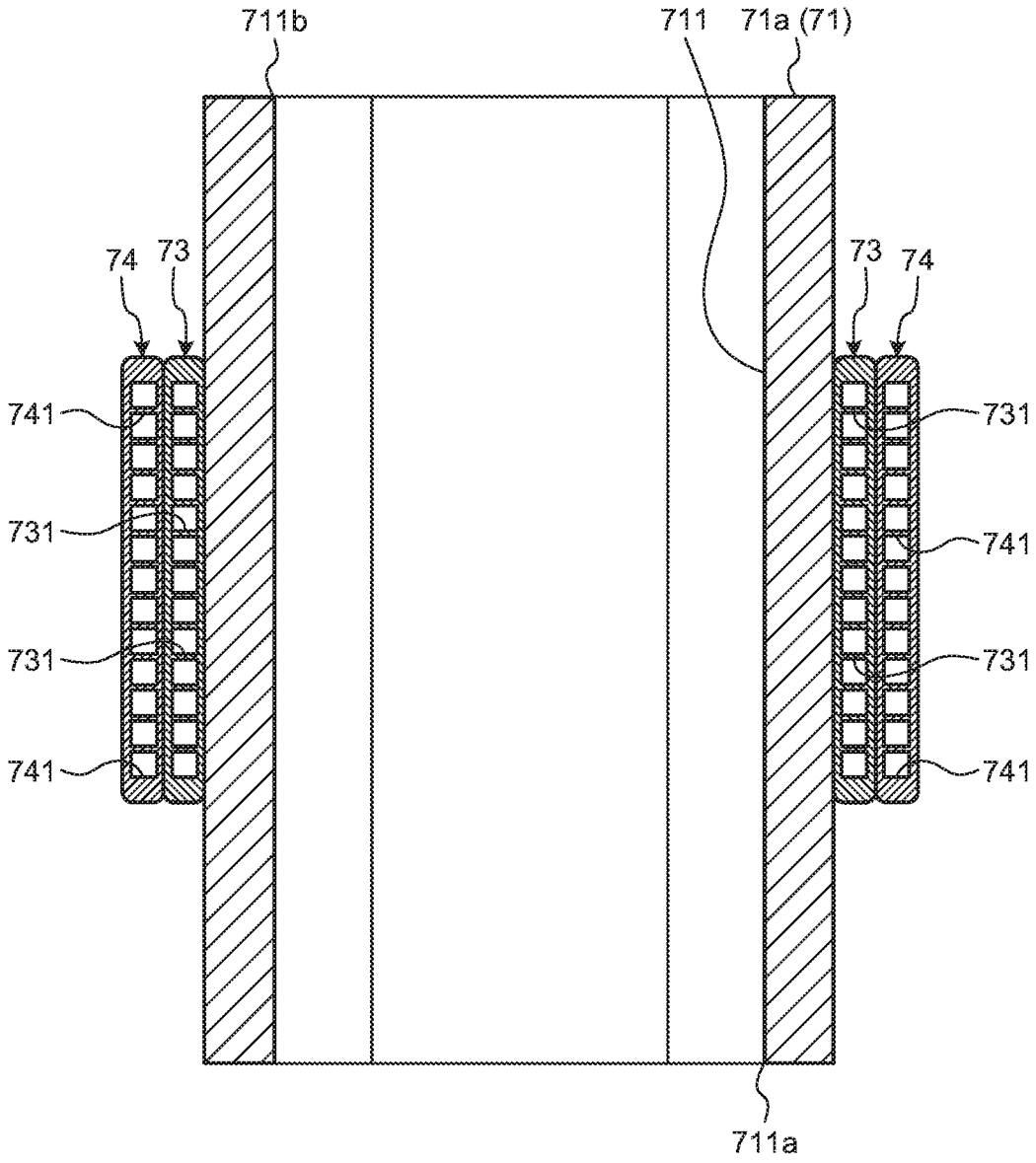
FIG. 20 is a vertical cross-sectional view of the ice making part illustrated in FIG. 19.

Similarly to the ice making main body 71 described above, the first refrigerant pipe part 73 is made of aluminum. As illustrated in FIG. 20, the first refrigerant pipe part 73 is a flat perforated tube in which a plurality of refrigerant passages 731 are arranged in parallel. The first refrigerant pipe part 73 is arranged around the ice making main body 71 in a state in which an inner face thereof is thermally connected to the front face and the rear face of the ice making main body 71. A first inlet header 73*a* is arranged at one end part of the first refrigerant pipe part 73 so as to communicate with each refrigerant passage 731, and a first outlet header 73*b* is arranged at the other end part thereof so as to communicate with each refrigerant passage 731.

Similarly to the ice making main body 71 and the first refrigerant pipe part 73 described above, the second refrigerant pipe part 74 is made of aluminum. As illustrated in FIG. 20, the second refrigerant pipe part 74 is a flat perforated tube in which a plurality of refrigerant passages 741 are arranged in parallel. The second refrigerant pipe part 74 is arranged overlapping with the first refrigerant pipe part 73 in a state in which an inner face of the second refrigerant pipe part 74 is thermally connected to an outer face of the first refrigerant pipe part 73. A second inlet header 74*a* is arranged at one end part of the second refrigerant pipe part 74 so as to communicate with each refrigerant passage 741, and a second outlet header 74*b* is arranged at the other end part thereof so as to communicate with each refrigerant passage 741.

In the second refrigerant pipe part 74, the second inlet header 74*a* is arranged outside the first outlet header 73*b*, and the second outlet header 74*b* is arranged outside the first inlet header 73*a*. Thus, the second refrigerant pipe part 74 is thermally connected to the first refrigerant pipe part 73 such that the refrigerant passing through each refrigerant passage 741 is opposed to the refrigerant passing through the refrigerant passage 731 of the first refrigerant pipe part 73.

The first refrigerant pipe part 73 and the second refrigerant pipe part 74 constitute, as an evaporator, a refrigerating circuit for ice making 100 together with a compressor 101, a condenser 102, and an electronic expansion valve 103. The refrigerating circuit for ice making 100 is configured by sequentially connecting the compressor 101, the condenser 102, the electronic expansion valve 103, the first refrigerant pipe part 73, and the second refrigerant pipe part 74 via a refrigerant pipeline 104, and encloses the refrigerant therein. The refrigerant pipeline 104 is configured with a single piece of refrigerant piping, or configured by connecting a plurality of pieces of refrigerant piping.

A suction part of the compressor 101 is connected to the first outlet header 73*b* and the second outlet header 74*b* via the refrigerant pipeline 104, and the compressor 101 works when receiving a drive command from an controller 100*a* as a control module. When working, the compressor 101 suctions and compresses the refrigerant from the first refrigerant pipe part 73 and the second refrigerant pipe part 74, and discharges the compressed refrigerant through a discharging part.

The controller 100*a* integrally controls operations of respective parts of the refrigerating circuit for ice making 100. For example, the controller 100*a* may be implemented by causing a processing device such as a central processing unit (CPU) to execute a computer program, that is, implemented by software, may be implemented by hardware such as an integrated circuit (IC), or implemented by using both of the software and the hardware.

An inlet of the condenser 102 is connected to the discharging part of the compressor 101 via the refrigerant pipeline 104. The condenser 102 exchanges heat of the refrigerant discharged from the compressor 101 with heat of the ambient air, and causes the refrigerant to be condensed.

A first valve 105 is arranged in the middle of the refrigerant pipeline 104 connecting the compressor 101 with the condenser 102.

The first valve 105 is a valve body that opens and closes in response to a command given from the controller 100*a*, which allows the refrigerant discharged from the compressor 101 to pass therethrough toward the condenser 102 in the opened state, and regulates passage of the refrigerant discharged from the compressor 101 toward the condenser 102 in the closed state.

An inlet side of the electronic expansion valve 103 is connected to an outlet of the condenser 102 via the refrigerant pipeline 104, and an outlet side thereof is connected to the first inlet header 73*a* and the second inlet header 74*a* via the refrigerant pipeline 104. The electronic expansion valve 103 has an opening that is adjusted in accordance with a command given from the controller 100*a*, decompresses the refrigerant condensed by the condenser 102 to be adiabatically expanded, and supplies the refrigerant to the first refrigerant pipe part 73 and the second refrigerant pipe part 74.

In the refrigerating circuit for ice making 100 described above, a bypass pipeline 106 is arranged to join the middle of the refrigerant pipeline 104 connecting the electronic expansion valve 103 with the first inlet header 73*a* and the second inlet header 74*a*, the bypass pipeline 106 being branched from an upstream side of the first valve 105 in the refrigerant pipeline 104 connecting the compressor 101 with the condenser 102. A second valve 107 is arranged in the middle of the bypass pipeline 106.

The second valve 107 is a valve body that opens and closes in response to a command given from the controller 100*a*, which allows the refrigerant discharged from the compressor 101 to pass through the bypass pipeline 106 toward the first inlet header 73*a* and the second inlet header 74*a* in the opened state, and regulates passage of the refrigerant discharged from the compressor 101 through the bypass pipeline 106 in the closed state.

The evaporator (the first refrigerant pipe part 73 and the second refrigerant pipe part 74) cools or heats the ice making main body 71 thermally connected thereto when the refrigerant flowed in through the first inlet header 73*a* passes through the refrigerant passage 731 and the refrigerant flowed in through the second inlet header 74*a* passes through the refrigerant passage 741. That is, the evaporator cools the ice making main body 71 to below the freezing point when the refrigerant adiabatically expanded by the electronic expansion valve 103 passes through the refrigerant passages 731 and 741 to be evaporated, and heats the ice making main body 71 when the refrigerant compressed by the compressor 101 to be discharged flows in through the bypass pipeline 106 and passes through the refrigerant passages 731 and 741.

The ice making device 3 having the configuration as described above produces ice as follows. It is assumed that the water stored in the water storage part 10' is cooled to about 4° C., and the water in the water storage part 10' reaches the upper limit water level and has entered the hollow part 711 as ice making water.

When receiving the ice making command, the controller 100*a* causes the first valve 105 to be in the opened state and causes the second valve 107 to be in the closed state, and causes the compressor 101 to work while causing the electronic expansion valve 103 to have a predetermined opening.

Accordingly, in the refrigerating circuit for ice making 100, the refrigerant compressed by the compressor 101 is condensed by the condenser 102, adiabatically expanded by the electronic expansion valve 103, and passes through the respective refrigerant passages 731 and 741 of the first refrigerant pipe part 73 and the second refrigerant pipe part 74. Accordingly, the ice making main body 71 thermally connected to the first refrigerant pipe part 73 and the second refrigerant pipe part 74 is cooled. The refrigerant that has passed through the respective refrigerant passages 731 and 741 of the first refrigerant pipe part 73 and the second refrigerant pipe part 74 reaches the first outlet header 73*b* and the second outlet header 74*b*, and is discharged from the first outlet header 73*b* and the second outlet header 74*b* to be suctioned by the compressor 101. In this way, by cooling the entire first refrigerant pipe part 73 and second refrigerant pipe part 74 to be equal to or lower than 0° C. by circulating the refrigerant in the refrigerating circuit for ice making 100, the ice making water can be cooled to be equal to or lower than 0° C.

In this way, by causing the refrigerant to pass through each refrigerant passage 731 of the first refrigerant pipe part 73 and each refrigerant passage 741 of the second refrigerant pipe part 74, the refrigerant passing through the first refrigerant pipe part 73 and the refrigerant passing through the second refrigerant pipe part 74 flow in opposite directions. Accordingly, a sufficiently cooled refrigerant can be uniformly passed through the respective refrigerant passages 731 and 741 of the first refrigerant pipe part 73 and the second refrigerant pipe part 74 that are thermally connected to each other, and the degree of superheat as a temperature difference between the inlet temperature and the outlet temperature of the evaporator (the entire first refrigerant pipe part 73 and second refrigerant pipe part 74) can be minimized, that is, caused to be close to zero.

Due to this, the ice can be produced from the whole ice making water in the ice making part 70*a* at substantially the same time, and the time for producing ice can be prevented from fluctuating.

When the ice block is formed in the hollow part 711 of the ice making main body 71 as described above, the controller 100*a* causes the first valve 105 to be in the closed state, and causes the second valve 107 to be in the opened state. Accordingly, the refrigerant compressed by the compressor 101 passes through the bypass pipeline 106, and passes through the respective refrigerant passages 731 and 741 of the first refrigerant pipe part 73 and the second refrigerant pipe part 74 as hot gas. As a result, the ice making main body 71 is heated, and a boundary portion of the ice block being in contact with the inner wall surface of the hollow part 711 is melted. Thereafter, by causing the ice carrying-out module (not illustrated) to work, the ice block in the hollow part 711 can be carried out to a predetermined part through the upper surface opening 711*b* of the hollow part 711. After the ice block is carried out, the compressor 101 is stopped to end production of the ice.

As described above, in the ice making device 3 according to the third embodiment of the disclosure, the first refrigerant pipe part 73 having a flat shape in which a plurality of refrigerant passages 731 are arranged in parallel is arranged being curved around the ice making main body 71 such that the inner face of the first refrigerant pipe part 73 is thermally connected to the front face and the rear face of the ice making main body 71, and the second refrigerant pipe part 74 having a flat shape in which a plurality of refrigerant passages 741 are arranged in parallel is arranged being overlapped with the first refrigerant pipe part 73 such that the inner face of the second refrigerant pipe part 74 is thermally connected to the outer face of the first refrigerant pipe part 73 and the refrigerant passing through the refrigerant passage 741 is opposed to the refrigerant passing through the refrigerant passage 731 of the first refrigerant pipe part 73, so that the degree of superheat as a temperature difference between the inlet temperature and the outlet temperature in the entire first refrigerant pipe part 73 and second refrigerant pipe part 74 can be minimized, and the time for producing ice can be prevented from fluctuating. Accordingly, the ice can be favorably produced by the ice making part 70*a*, and driving time of the compressor 101 can be shortened.

In the ice making device 3 described above, the ice making main body 71, the first refrigerant pipe part 73, and the second refrigerant pipe part 74 constituting the ice making part 70*a* are made of aluminum, so that the production cost can be reduced and the heat transfer performance can be improved. Additionally, the ice making main body 71 is joined to the first refrigerant pipe part 73 using the same kind of metal, so that galvanic corrosion and the like are not caused, the galvanic corrosion being problematic in the related art in joining different kinds of metals, that is, copper and stainless steel.

In the ice making device 3, the ice making main body 71 is formed such that a plurality of tubular bodies 71*a* are continuously arranged, and the first refrigerant pipe part 73 has a flat shape in which a plurality of refrigerant passages 731 are arranged in parallel, so that the ice making main body 71 and the first refrigerant pipe part 73 can be thermally connected to each other in surface contact, and a heat transfer area can be increased to improve heat transfer efficiency.

Fourth Embodiment

Figure 21:
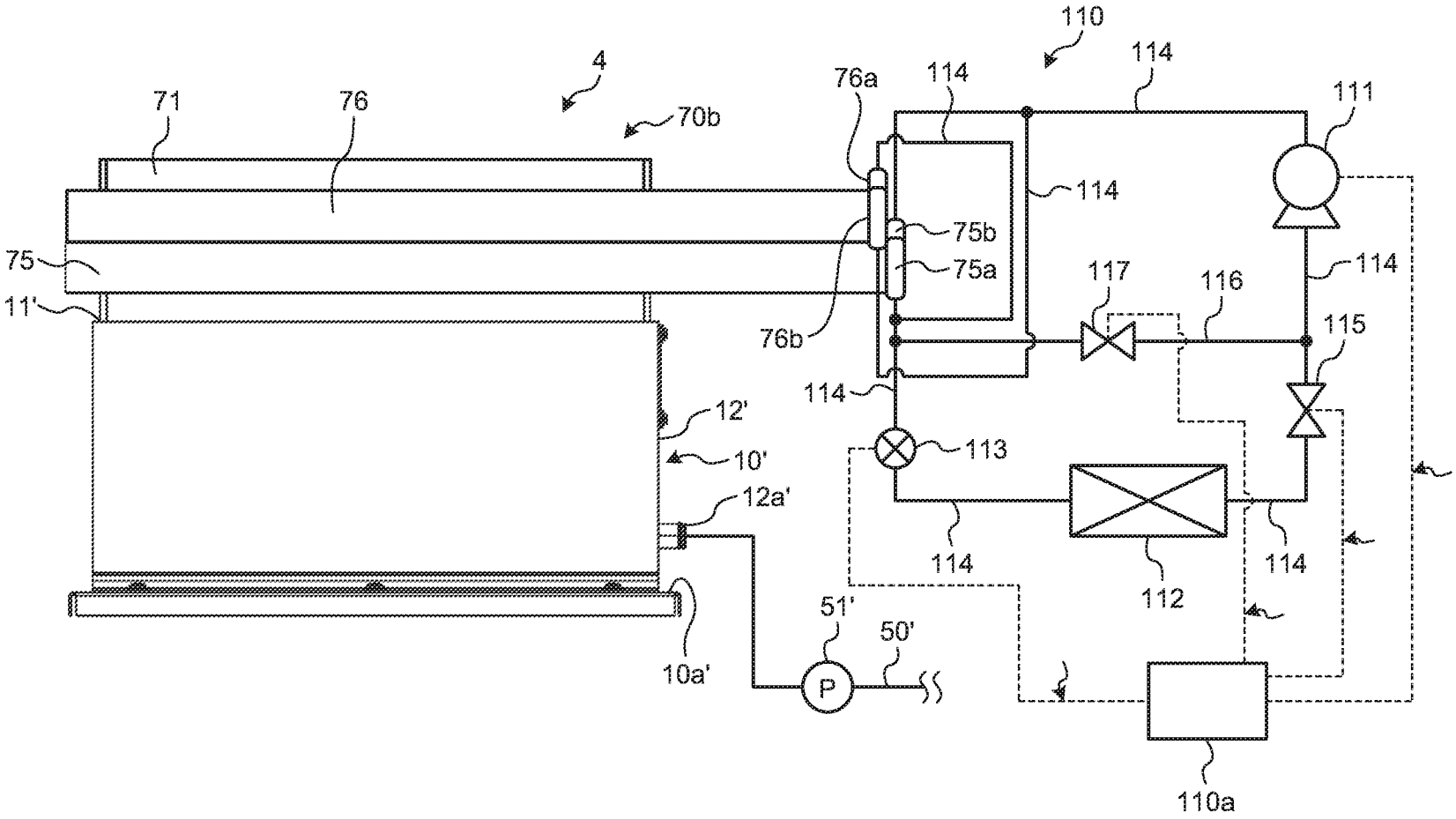
FIG. 21 is a schematic diagram schematically illustrating an ice making device according to a fourth embodiment of the disclosure.

FIG. 21 is a schematic diagram schematically illustrating the ice making device according to a fourth embodiment of the disclosure. The same component as that in the second embodiment described above is denoted by the same reference numeral, and redundant description will not be repeated. An ice making device 4 exemplified herein includes the water storage part 10' and an ice making part 70*b*.

The ice making part 70*b* includes the ice making main body 71, a first refrigerant pipe part 75, and a second refrigerant pipe part 76. The ice making main body 71 is made of aluminum. The ice making main body 71 is configured such that a plurality of (eight) tubular bodies 71*a* each having the hollow part 711 extending in the vertical direction are continuously arranged side by side. The ice making main body 71 is placed on the upper wall part 11' such that the lower surface opening 711*a* (refer to FIG. 22) of each hollow part 711 communicates with a corresponding upper wall opening. Herein, the front and rear width and the left and right width of the hollow part 711 are substantially equal to the front and rear width and the left and right width of the upper wall opening.

Figure 22:
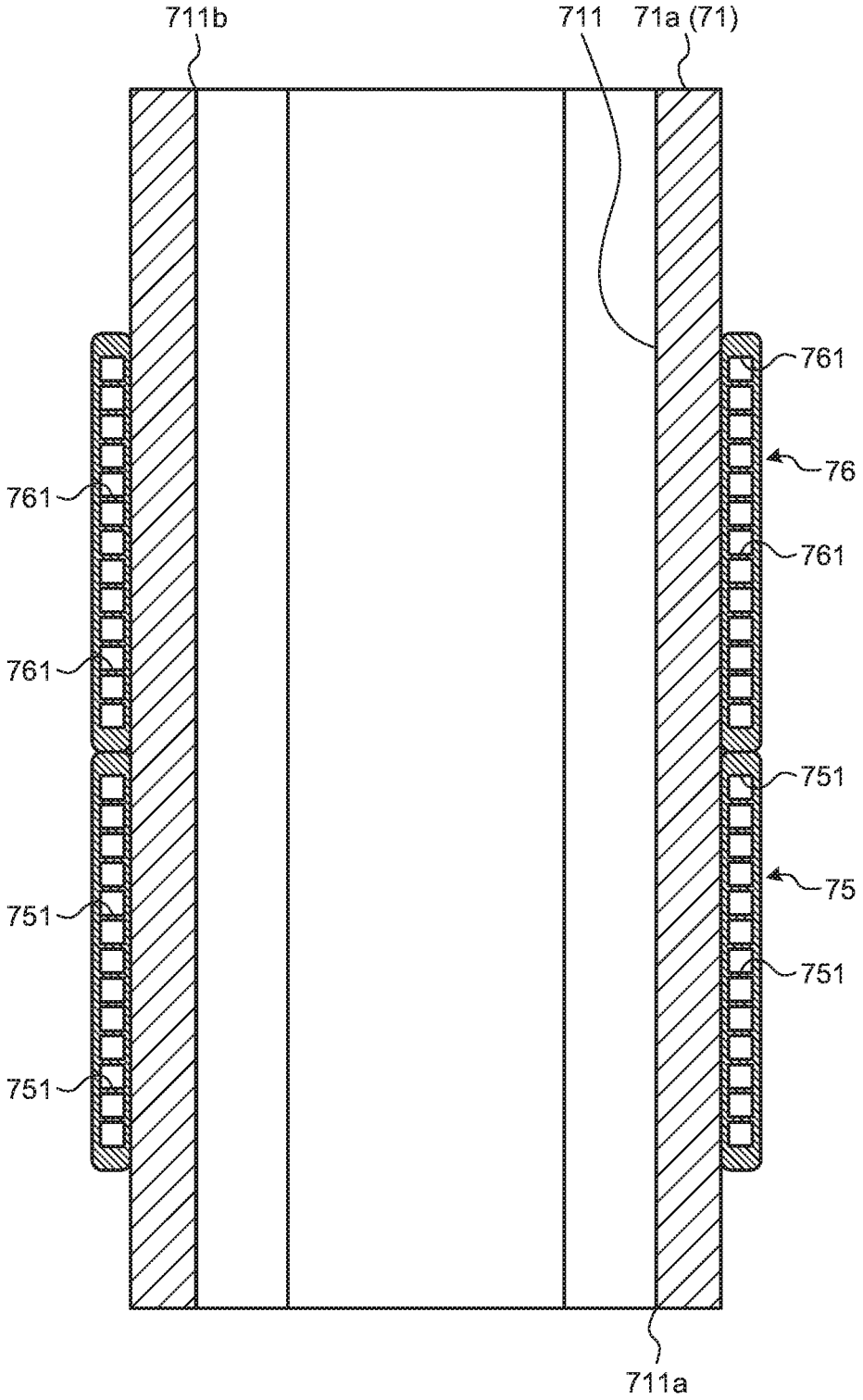
FIG. 22 is a vertical cross-sectional view of the ice making part illustrated in FIG. 21.

Similarly to the ice making main body 71 described above, the first refrigerant pipe part 75 is made of aluminum. As illustrated in FIG. 22, the first refrigerant pipe part 75 is a flat perforated tube in which a plurality of refrigerant passages 751 are arranged in parallel. The first refrigerant pipe part 75 is arranged around the ice making main body 71 in a state in which the inner face of the first refrigerant pipe part 75 is thermally connected to the front face and the rear face of the ice making main body 71. A first inlet header 75*a* is arranged at one end part of the first refrigerant pipe part 75 so as to communicate with each refrigerant passage 751, and a first outlet header 75*b* is arranged at the other end part thereof so as to communicate with each refrigerant passage 751.

Similarly to the ice making main body 71 and the first refrigerant pipe part 75 described above, the second refrigerant pipe part 76 is made of aluminum. As illustrated in FIG. 22, the second refrigerant pipe part 76 is a flat perforated tube in which a plurality of refrigerant passages 761 are arranged in parallel. The second refrigerant pipe part 76 is arranged around the ice making main body 71 in a state in which a lower part of the second refrigerant pipe part 76 is thermally connected to an upper part of the first refrigerant pipe part 75, and the inner face of the second refrigerant pipe part 76 is thermally connected to the front face and the rear face of the ice making main body 71. A second inlet header 76*a* is arranged at one end part of the second refrigerant pipe part 76 so as to communicate with each refrigerant passage 761, and a second outlet header 76*b* is arranged at the other end part thereof so as to communicate with each refrigerant passage 761.

In the second refrigerant pipe part 76, the second inlet header 76*a* is arranged upper than the first outlet header 75*b*, and the second outlet header 76*b* is arranged upper than the first inlet header 75*a*. Thus, the second refrigerant pipe part 76 is thermally connected to the first refrigerant pipe part 75 such that the refrigerant passing through each refrigerant passage 761 is opposed to the refrigerant passing through the refrigerant passage 751 of the first refrigerant pipe part 75.

The first refrigerant pipe part 75 and the second refrigerant pipe part 76 constitute, as an evaporator, a refrigerating circuit for ice making 110 together with a compressor 111, a condenser 112, and an electronic expansion valve 113. The refrigerating circuit for ice making 110 is configured by sequentially connecting the compressor 111, the condenser 112, the electronic expansion valve 113, the first refrigerant pipe part 75, and the second refrigerant pipe part 76 via a refrigerant pipeline 114, and encloses the refrigerant therein. The refrigerant pipeline 114 is configured with a single piece of refrigerant piping, or configured by connecting a plurality of pieces of refrigerant piping.

A suction part of the compressor 111 is connected to the first outlet header 75*b* and the second outlet header 76*b* via the refrigerant pipeline 114, and the compressor 111 works when receiving a drive command from an controller 110*a* as a control module. When working, the compressor 111 suctions and compresses the refrigerant from the first refrigerant pipe part 75 and the second refrigerant pipe part 76, and discharges the compressed refrigerant through a discharging part.

The controller 110*a* integrally controls operations of respective parts of the refrigerating circuit for ice making 110. For example, the controller 110*a* may be implemented by causing a processing device such as a central processing unit (CPU) to execute a computer program, that is, implemented by software, may be implemented by hardware such as an integrated circuit (IC), or implemented by using both of the software and the hardware.

An inlet of the condenser 112 is connected to the discharging part of the compressor 111 via the refrigerant pipeline 114. The condenser 112 exchanges heat of the refrigerant discharged from the compressor 111 with heat of the ambient air, and causes the refrigerant to be condensed. A first valve 115 is arranged in the middle of the refrigerant pipeline 114 connecting the compressor 111 with the condenser 112.

The first valve 115 is a valve body that opens and closes in response to a command given from the controller 110*a*, which allows the refrigerant discharged from the compressor 111 to pass therethrough toward the condenser 112 in the opened state, and regulates passage of the refrigerant discharged from the compressor 111 toward the condenser 112 in the closed state.

An inlet side of the electronic expansion valve 113 is connected to an outlet of the condenser 112 via the refrigerant pipeline 114, and an outlet side thereof is connected to the first inlet header 75*a* and the second inlet header 76*a* via the refrigerant pipeline 114. The electronic expansion valve 113 has an opening that is adjusted in accordance with a command given from the controller 110*a*, decompresses the refrigerant condensed by the condenser 112 to be adiabatically expanded, and supplies the refrigerant to the first refrigerant pipe part 75 and the second refrigerant pipe part 76.

In the refrigerating circuit for ice making 110 described above, a bypass pipeline 116 is arranged to join the middle of the refrigerant pipeline 114 connecting the electronic expansion valve 113 with the first inlet header 75*a* and the second inlet header 76*a*, the bypass pipeline 116 being branched from an upstream side of the first valve 115 in the refrigerant pipeline 114 connecting the compressor 111 with the condenser 112. A second valve 117 is arranged in the middle of the bypass pipeline 116.

The second valve 117 is a valve body that opens and closes in response to a command given from the controller 110*a*, which allows the refrigerant discharged from the compressor 111 to pass through the bypass pipeline 116 toward the first inlet header 75*a* and the second inlet header 76*a* in the opened state, and regulates passage of the refrigerant discharged from the compressor 111 through the bypass pipeline 116 in the closed state.

The evaporator (the first refrigerant pipe part 75 and the second refrigerant pipe part 76) cools or heats the ice making main body 71 thermally connected thereto when the refrigerant flowed in through the first inlet header 75*a* passes through the refrigerant passage 751 and the refrigerant flowed in through the second inlet header 76*a* passes through the refrigerant passage 761. That is, the evaporator cools the ice making main body 71 to below the freezing point when the refrigerant adiabatically expanded by the electronic expansion valve 113 passes through the refrigerant passages 751 and 761 to be evaporated, and heats the ice making main body 71 when the refrigerant compressed by the compressor 111 to be discharged flows in through the bypass pipeline 116 and passes through the refrigerant passages 751 and 761.

The ice making device 4 having the configuration as described above produces ice as follows. It is assumed that the water stored in the water storage part 10' is cooled to about 4° C., and the water in the water storage part 10' reaches the upper limit water level and has entered the hollow part 711 as ice making water.

When receiving the ice making command, the controller 110*a* causes the first valve 115 to be in the opened state and causes the second valve 117 to be in the closed state, and causes the compressor 111 to work while causing the electronic expansion valve 113 to have a predetermined opening.

Accordingly, in the refrigerating circuit for ice making 110, the refrigerant compressed by the compressor 111 is condensed by the condenser 112, adiabatically expanded by the electronic expansion valve 113, and passes through the respective refrigerant passages 751 and 761 of the first refrigerant pipe part 75 and the second refrigerant pipe part 76. Accordingly, the ice making main body 71 thermally connected to the first refrigerant pipe part 75 and the second refrigerant pipe part 76 is cooled. The refrigerant that has passed through the respective refrigerant passages 751 and 761 of the first refrigerant pipe part 75 and the second refrigerant pipe part 76 reaches the first outlet header 75*b* and the second outlet header 76*b*, and is discharged from the first outlet header 75*b* and the second outlet header 76*b* to be suctioned by the compressor 111. In this way, by cooling the entire first refrigerant pipe part 75 and second refrigerant pipe part 76 to be equal to or lower than 0° C. by circulating the refrigerant in the refrigerating circuit for ice making 110, the ice making water can be cooled to be equal to or lower than 0° C.

In this way, by causing the refrigerant to pass through each refrigerant passage 751 of the first refrigerant pipe part 75 and each refrigerant passage 761 of the second refrigerant pipe part 76, the refrigerant passing through the first refrigerant pipe part 75 and the refrigerant passing through the second refrigerant pipe part 76 flow in opposite directions. Accordingly, a sufficiently cooled refrigerant can be uniformly passed through the respective refrigerant passages 751 and 761 of the first refrigerant pipe part 75 and the second refrigerant pipe part 76 that are thermally connected to each other, and the degree of superheat as a temperature difference between the inlet temperature and the outlet temperature of the evaporator (the entire first refrigerant pipe part 75 and second refrigerant pipe part 76) can be minimized, that is, caused to be close to zero.

Due to this, the ice can be produced from the whole ice making water in the ice making part 70*b* at substantially the same time, and the time for producing ice can be prevented from fluctuating.

When the ice block is formed in the hollow part 711 of the ice making main body 71 as described above, the controller 110*a* causes the first valve 115 to be in the closed state, and causes the second valve 117 to be in the opened state. Accordingly, the refrigerant compressed by the compressor 111 passes through the bypass pipeline 116, and passes through the respective refrigerant passages 751 and 761 of the first refrigerant pipe part 75 and the second refrigerant pipe part 76 as hot gas. As a result, the ice making main body 71 is heated, and a boundary portion of the ice block being in contact with the inner wall surface of the hollow part 711 is melted. Thereafter, by causing the ice carrying-out module (not illustrated) to work, the ice block in the hollow part 711 can be carried out to a predetermined part through the upper surface opening 711*b* of the hollow part 711. After the ice block is carried out, the compressor 111 is stopped to end production of the ice.

As described above, in the ice making device 4 according to the fourth embodiment of the disclosure, the first refrigerant pipe part 75 having a flat shape in which a plurality of refrigerant passages 751 are arranged in parallel is arranged being curved around the ice making main body 71 such that the inner face of the first refrigerant pipe part 75 is thermally connected to the front face and the rear face of the ice making main body 71, and the second refrigerant pipe part 76 having a flat shape in which a plurality of refrigerant passages 761 are arranged in parallel is arranged being curved around the ice making main body 71 such that a lower part of the second refrigerant pipe part 76 is thermally connected to an upper part of the first refrigerant pipe part 75 and the inner face thereof is thermally connected to the front face and the rear face of the ice making main body 71, and the refrigerant passing through the refrigerant passage 761 is opposed to the refrigerant passing through the refrigerant passage 751 of the first refrigerant pipe part 75, so that the degree of superheat as a temperature difference between the inlet temperature and the outlet temperature in the entire first refrigerant pipe part 75 and second refrigerant pipe part 76 can be minimized, and the time for producing ice can be prevented from fluctuating. Accordingly, the ice can be favorably produced by the ice making part 70*b*, and driving time of the compressor 111 can be shortened.

In the ice making device 4 described above, the ice making main body 71, the first refrigerant pipe part 75, and the second refrigerant pipe part 76 constituting the ice making part 70*b* are made of aluminum, so that the production cost can be reduced and the heat transfer performance can be improved. Additionally, the ice making main body 71 is joined to the first refrigerant pipe part 75 and the second refrigerant pipe part 76 using the same kind of metal, so that galvanic corrosion and the like are not caused, the galvanic corrosion being problematic in the related art in joining different kinds of metals, that is, copper and stainless steel.

In the ice making device 4, the ice making main body 71 is formed such that a plurality of tubular bodies 71*a* are continuously arranged, and the first refrigerant pipe part 75 and the second refrigerant pipe part 76 have a flat shape in which a plurality of refrigerant passages 751 and 761 are arranged in parallel, so that the ice making main body 71 can be thermally connected to the first refrigerant pipe part 75 and the second refrigerant pipe part 76 in surface contact, and a heat transfer area can be increased to improve heat transfer efficiency.

The preferred first to fourth embodiments of the disclosure have been described above. However, the disclosure is not limited thereto, and various modifications can be made.

In the first embodiment described above, the circulation amount of the refrigerant in the refrigerating circuit for ice making 60 is adjusted by increasing or reducing the opening of the electronic expansion valve 63. Alternatively, according to the disclosure, the circulation amount of the refrigerant in the refrigerating circuit for ice making 60 may be adjusted by increasing or reducing the number of revolutions of the compressor.

Although not specifically mentioned in the first embodiment described above, in producing ice by the ice making part, a crack may be caused in produced ice by rapidly changing the temperature of the refrigerant passing through the refrigerant pipeline 64. Due to this, a load required for crushing the produced ice can be reduced.

In the first embodiment described above, the water in the ice making part 20 is caused to flow when the controller 40 repeatedly causes the water supply pump 51 to work and stop until the ice making time elapses to cause the water level of the water stored in the water storage part 10 to fluctuate. Alternatively, the water in the ice making part 20 may be caused to flow by reciprocatively moving the pusher member 31 in the vertical direction during a period in which the ice is produced by the ice making part 20. Accordingly, air bubbles included in the water can be removed when the ice is frozen, and transparent ice can be produced. Alternatively, the water level may be caused to fluctuate by opening and closing an overflow formed in the water storage part with a drain valve while causing the water supply pump 51 to work.

The second embodiment described above exemplifies the switching unit 90 including the cross valve 91. However, according to the disclosure, various configurations thereof may be employed so long as the first sending-out state in which the refrigerant decompressed by the electronic expansion valve 83 is sent out to one end part of the refrigerant pipe part and the second sending-out state in which the refrigerant decompressed by the electronic expansion valve 83 is sent out to the other end part of the refrigerant pipe part can be switched to each other for each predetermined time.

In the third and the fourth embodiments described above, the second refrigerant pipe part 74 is overlapped with the outer face of the first refrigerant pipe part 73, or the second refrigerant pipe part 76 is in contact with the upper part of the first refrigerant pipe part 75. However, according to the disclosure, various configurations may be employed so long as the second refrigerant pipe part is thermally connected to the first refrigerant pipe part such that the refrigerant passing through the refrigerant passage of the second refrigerant pipe part is opposed to the refrigerant passing through the refrigerant passage of the first refrigerant pipe part.

According to the disclosure, when the ice making command is given, the controller increases the circulation amount of the refrigerant in the refrigerating circuit for ice making and then reduces the circulation amount in accordance with reduction in the cooling load in the ice making part, and adjusts the circulation amount such that the degree of superheat as a difference between the refrigerant temperature at the inlet of the evaporator and the refrigerant temperature at the outlet thereof is equal to or lower than 2° C., so that the time for producing ice can be prevented from fluctuating, and the ice is favorably produced by the ice making part, and the driving time of the compressor can be shortened.

According to the disclosure, the switch is switched for each predetermined time between the first sending-out state in which the refrigerant decompressed by the electronic expansion valve is sent out to one end part of the refrigerant pipe part and the second sending-out state in which the refrigerant decompressed by the electronic expansion valve is sent out to the other end part of the refrigerant pipe part, so that the degree of superheat as a temperature difference between the inlet temperature and the outlet temperature in the refrigerant pipe part can be minimized, and the time for producing ice can be prevented from fluctuating. Accordingly, the ice can be favorably produced by the ice making part, and the driving time of the compressor can be shortened.

Additionally, according to the disclosure, the first refrigerant pipe part having a flat shape in which a plurality of refrigerant passages are arranged in parallel is arranged being curved around the ice making main body such that the inner face of the first refrigerant pipe part is thermally connected to the front face and the rear face of the ice making main body, and the second refrigerant pipe part having a flat shape in which a plurality of refrigerant passages are arranged in parallel is arranged being thermally connected to the first refrigerant pipe part such that the refrigerant passing through the refrigerant passage of the second refrigerant pipe part is opposed to the refrigerant passing through the refrigerant passage of the first refrigerant pipe part, so that the degree of superheat as a temperature difference between the inlet temperature and the outlet temperature in the entire first refrigerant pipe part and second refrigerant pipe part can be minimized, and the time for producing ice can be prevented from fluctuating. Accordingly, the ice can be favorably produced by the ice making part, and the driving time of the compressor can be shortened.

Although the disclosure has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An ice making device comprising:

an ice making part in which an evaporator is incorporated;

a refrigerating circuit for ice making including a compressor, a condenser, an electronic expansion valve, and the evaporator, the refrigerating circuit being configured to circulate a refrigerant through the compressor, the condenser, the electronic expansion valve, and the evaporator in this order to produce ice in the ice making part; and a controller configured to increase a circulation amount of the refrigerant in the refrigerating circuit and then reduce the circulation amount in accordance with reduction in a cooling load in the ice making part when receiving an ice making command, and adjust the circulation amount such that a degree of superheat is equal to or lower than 2° C., the degree of superheat being a difference between a refrigerant temperature at an inlet of the evaporator and a refrigerant temperature at an outlet of the evaporator, wherein the ice making part comprises an ice making main body in which a plurality of tubular bodies are continuously arranged in parallel, and the evaporator comprises a refrigerant pipe part having a flat shape in which a plurality of refrigerant passages are arranged in parallel, and the refrigerant pipe part is arranged in a configuration being curved around the ice making main body to be incorporated in the ice making art such that an inner face of the refrigerant pipe part is thermally connected to a front face and a rear face of the ice making main body.

2. The ice making device according to claim 1, wherein, when receiving the ice making command, the controller causes an opening of the electronic expansion valve to be full-opened and then reduces the opening of the electronic expansion valve in accordance with reduction in the cooling load in the ice making part, and adjusts the opening of the electronic expansion valve such that the degree of superheat is equal to or lower than 2° C.

3. The ice making device according to claim 2, wherein, when the degree of superheat comes close to zero by reducing the opening of the electronic expansion valve in accordance with reduction in the cooling load in the ice making part, the controller further reduces the opening of the electronic expansion valve to increase the degree of superheat, and then adjusts the opening of the electronic expansion valve such that the degree of superheat is equal to or lower than 2° C.

4. The ice making device according to claim 1, wherein the ice making main body and the refrigerant pipe part are made of aluminum.

* * * * *